US012258977B2

(12) United States Patent
Xu et al.

(10) Patent No.: US 12,258,977 B2
(45) Date of Patent: Mar. 25, 2025

(54) ROTARY DEVICE FOR INPUTTING THERMAL ENERGY INTO FLUIDS

(71) Applicant: Coolbrook Oy, Helsinki (FI)

(72) Inventors: Liping Xu, Cambridge (GB); Budimir Rosic, Oxford (GB)

(73) Assignee: COOLBROOK OY, Helsinki (FI)

( * ) Notice: Subject to any disclaimer, the term of this patent is extended or adjusted under 35 U.S.C. 154(b) by 0 days.

(21) Appl. No.: 18/145,355

(22) Filed: Dec. 22, 2022

(65) Prior Publication Data

US 2023/0204046 A1 Jun. 29, 2023

(30) Foreign Application Priority Data

Dec. 23, 2021 (FI) ..... 20216338

(51) Int. Cl.
*F04D 29/58* (2006.01)
*F04D 27/00* (2006.01)
(Continued)

(52) U.S. Cl.
CPC ..... *F04D 29/5893* (2013.01); *F04D 27/002* (2013.01); *F04D 29/445* (2013.01); *F24H 4/00* (2013.01); *F24H 15/375* (2022.01)

(58) Field of Classification Search
CPC .. F04D 27/002; F04D 29/445; F04D 29/5893; F04D 29/542; F04D 29/547;
(Continued)

(56) References Cited

U.S. PATENT DOCUMENTS 4,357,931 A 11/1982 Wolpert et al.
5,601,401 A * 2/1997 Matheny ..... F01D 17/162 415/160
(Continued)

FOREIGN PATENT DOCUMENTS

CA 2766338 A1 * 9/2010 ..... B01J 19/0066
EP 1 063 273 A1 12/2000
(Continued)

OTHER PUBLICATIONS

International Search Report, PCT/FI2022/050868, dated Feb. 14, 2023 (6 pp.).
(Continued)

*Primary Examiner* — Steven B McAllister
*Assistant Examiner* — John E Bargero
(74) *Attorney, Agent, or Firm* — Eversheds Sutherland (US) LLP

(57) ABSTRACT

A rotary apparatus for inputting thermal energy into fluidic medium is provided, the apparatus is being configured to impart an amount of thermal energy to a stream of fluidic medium directed along a flow path formed inside the casing between the inlet and the outlet by virtue of a series of energy transformations occurring when said stream of fluidic medium successively passes through the blade/vane rows formed by the nozzle guide vanes, the rotor blades and the diffuser vanes, respectively. A space formed between an exit from the at least one row of diffuser vanes and an entrance to the at least one row of nozzle guide vanes in a direction of the flow path formed inside the casing between the inlet and the outlet is made variable to regulate the amount of thermal energy input to the stream of fluidic medium propagating through the apparatus.

41 Claims, 15 Drawing Sheets

(51) Int. Cl.
*F04D 29/44* (2006.01)
*F24H 4/00* (2006.01)
*F24H 15/375* (2022.01)

(58) Field of Classification Search
CPC ..... F04D 29/56; F24H 15/375; F24H 4/00; F24D 40/10
USPC ..... 237/12.1
See application file for complete search history.

(56) References Cited

U.S. PATENT DOCUMENTS

| | | | |
|---|---|---|---|
| 10,744,480 | B2 | 8/2020 | Xu et al. |
| 2014/0243569 | A1 | 8/2014 | Seppala et al. |
| 2020/0114332 | A1 | 4/2020 | Xu et al. |

FOREIGN PATENT DOCUMENTS

| | | | |
|---|---|---|---|
| WO | 2016001476 | A1 | 1/2016 |
| WO | 2020060919 | A1 | 3/2020 |

OTHER PUBLICATIONS

Search Report and Communication of Acceptance issued by Finnish Patent Office for Finnish Patent Application No. 20216338 (7 pp.).

* cited by examiner

ROTARY DEVICE FOR INPUTTING THERMAL ENERGY INTO FLUIDS

FIELD OF THE INVENTION

The present invention relates to the field of rotary turbomachines. In particular, the invention concerns a rotary apparatus configured for inputting thermal energy (heat) into fluids, related arrangement, method and uses.

BACKGROUND

Industrial process heat defined as thermal energy used in preparation or processing of materials often associated with production of manufactured goods accounts for more than two-thirds of the total global industrial energy consumption. Key industries that support the global economy utilize high temperature heat processes including for example non-metallic minerals processing (mostly cement), production of hydrogen from natural gas, incineration of end-of-life plastics, chemical industry high-temperature heat processes (e.g. core processes to crack hydrocarbons into bulk chemicals and to transform limestone to cement clinker), iron and steel production (e.g. core processes to melt and form steel) and utilization of thus produced off-gases as a feedstock for bulk chemicals.

Most of the above-mentioned processes require very high temperatures, such as within a range of about 850 to 1600 degrees Celsius (° C.), and thus are extremely energy demanding. These processes typically employ heating utilities, such as for example fired heaters, with high demand for thermal energy and hence for heat consumption. To produce heat, these utilities use fossil fuels, such as for example natural gas and coal. Burning of fossil fuels accounts for generating a majority of greenhouse gas emissions and air pollutants, such as soot and smog, which markedly increases the risks of lung cancer, heart disease and a variety of respiratory illnesses amongst those exposed. Replacing fossil fuels with wood or other bio-based materials has significant resource limitations and other environmental implications, such as sustainable land use.

All the above said sets strict requirements on the energy sources and technologies used in the energy/heat-intensive industries. Although attempts are made to utilize "green" energy, such as electricity, in some of these processes (for example in electric arc furnaces to melt steel), in most cases, making the high temperature heat processes more energy-efficient and environmentally friendly requires changing the fundamentals of underlying industrial processes, which implies not only using the alternative energy sources, but also redesigning the existing equipment. At a time being, neither the technologies nor the economics are yet in place to do so.

Overall, rotary turbomachines are well known to deliver energy to fluids (compressors, fans or pumps). However, the work input in conventional compressor devices for example is relatively low.

A number of rotary solutions have been proposed for heating purposes. Thus, U.S. Pat. No. 11,098,725 B2 (Sanger et al) discloses a hydrodynamic heater pump device operable to selectively generate a stream of heated fluid and/or pressurized fluid. Mentioned hydrodynamic heater pump is designed to be incorporated in an automotive vehicle cooling system to provide heat for warming a passenger compartment of the vehicle and to provide other capabilities, such as window deicing and engine cooling. The disclosed device may also provide a stream of pressurized fluid for cooling an engine. Disclosed technology is based on friction; and, since the fluid to be heated is liquid, the presented design is not suitable for conditions involving extreme turbulence of gas aerodynamics.

U.S. Pat. No. 7,614,367 B1 (Frick) discloses a system and method for flamelessly heating, concentrating or evaporating a fluid by converting rotary kinetic energy into heat. Configured for fluid heating, the system may comprise a rotary kinetic energy generator, a rotary heating device and a primary heat exchanger all in closed-loop fluid communication. The rotary heating device may be a water brake dynamometer. The document discloses the use of the system for heating water in offshore drilling or production platforms. However, the presented system is not suitable for heating gaseous media, neither is it feasible for use with high- and extremely high temperatures (due to liquid stability, vapor pressure, etc.).

Additionally, turbomachine-type devices are known to implement the processes of hydrocarbon (steam) cracking and aim at maximizing the yields of the target products, such as ethylene and propylene.

None of the above-mentioned technologies provides a reasonable solution for the above identified problems, due to the hindrances associated with increasing the energy input into the high temperature heat intensive processes and associated equipment.

In this regard, an update in the field of technology related to design and manufacturing of efficient heating system, in particular those suitable for high- and extremely high temperature related applications, is still desired, in view of addressing challenges associated with raising temperatures of fluidic substances in efficient and environmentally friendly manner.

SUMMARY OF THE INVENTION

An objective of the present invention is to solve or to at least mitigate each of the problems arising from the limitations and disadvantages of the related art. The objective is achieved by various embodiments of a rotary apparatus for inputting thermal energy into fluidic medium, related arrangements, methods and uses. Thereby, in one aspect of the invention an apparatus for inputting thermal energy into fluidic medium is provided, according to what is defined in the independent claim 1.

In embodiment, the apparatus comprises: a casing with at least one inlet and at least one outlet; a rotor comprising at least one row of rotor blades configured as impulse impeller blades arranged over a circumference of a rotor hub mounted onto a rotor shaft; at least one row of stationary nozzle guide vanes arranged upstream of the at least one row of the rotor blades, respectively; and at least one row of stationary diffuser vanes arranged downstream of the at least one row of the rotor blades, respectively, wherein the apparatus is configured to impart an amount of thermal energy to a stream of fluidic medium directed along a flow path formed inside the casing between the inlet and the outlet by virtue of a series of energy transformations occurring when said stream of fluidic medium successively passes through the blade/vane rows formed by the nozzle guide vanes, the rotor blades and the diffuser vanes, respectively, and wherein, in said apparatus, a space formed between an exit from the at least one row of diffuser vanes and an entrance to the at least one row of nozzle guide vanes in a direction of the flow path formed inside the casing between the inlet and the outlet is made variable to regulate the amount of thermal energy input to the stream of fluidic medium propagating through the apparatus.

In embodiment, in said apparatus, the space formed between the exit from the at least one row of diffuser vanes and the entrance to the at least one row of nozzle guide vanes in a direction of the flow path formed inside the casing between the inlet and the outlet is made variable in terms of at least of size and shape.

In embodiments, said space is vaneless. In embodiments, said space comprises flow shaping device(s) and/or flow guide appliance(s), such as guidewalls.

In embodiments, in said apparatus the at least one row of stationary nozzle guide vanes, the at least one row of rotor blades and the at least one row of stationary diffuser vanes are configured to produce conditions, at which an amount of kinetic energy added to the stream of fluidic medium by rotating blades of the rotor is sufficient to raise the temperature of the fluidic medium to a predetermined value when said stream of fluidic medium exits the at least one row of rotor blades at a supersonic speed and passes through the at least one row of diffuser vanes, where the stream decelerates and dissipates kinetic energy into an internal energy of the fluidic medium, and an amount of thermal energy is added to the stream of fluidic medium.

In embodiments, in said apparatus, the amount of thermal energy added to the stream of fluidic medium propagating through the apparatus is produced by virtue of generation of a system of shock waves during successive propagation of said stream of fluidic medium through the at least one row of stationary nozzle guide vanes, the at least one row of rotor blades and the at least one row of stationary diffuser vanes, respectively, in a controlled manner.

In embodiments, in said apparatus, the at least one row of stationary nozzle guide vanes is configured as a flow conditioner device that directs the stream of fluidic medium towards the row(s) of rotor blades in a circumferential direction opposite to rotor blade rotation such, as to control the level of energy input from the rotor and the speed of the fluid.

In embodiments, the stationary nozzle guide vanes are configured to direct the stream of fluidic medium to enter the row of rotor blades with a relative blade angle within a range of between about 45 degrees to about 75 degrees as viewed from the axial direction.

In embodiments, the rotor blades are configured, upon rotation of the rotor, to receive the stream of fluidic medium from the stationary nozzle guide vanes and to accelerate said stream to a supersonic speed thus imparting mechanical energy to the process fluid by increasing tangential velocity thereof.

In embodiments, the rotor blade row(s) is/are configured to receive the stream of fluidic medium entering from any one of the axial-, diagonal- or radial directions and to cause changes in flow velocity such that the stream of fluidic medium is accelerated at least two-fold.

In embodiments, the rotor is configured, in terms of profiles and dimensions of the rotor blades and disposition thereof on the rotor hub, to control mechanical energy input to the stream of fluidic medium.

In embodiments, the at least one row of diffuser vanes is configured as an energy converter device, that converts mechanical energy of the fluidic medium into thermal energy of said fluidic medium.

In embodiments, the rotor comprises a shroud configured to cover the at least one row of rotor blades.

In embodiments, the row of stationary nozzle guide vanes, the row of rotor blades and the row of stationary diffuser vanes establish an energy transfer stage, configured to mediate a complete energy conversion cycle.

In embodiments, a distance between the at least one row of stationary diffuser vanes and the at least one row of stationary nozzle guide vanes is variable.

In embodiments, the apparatus comprises at least two rows of rotor blades successively arranged on the rotor shaft.

In embodiments, the apparatus comprises a number of energy transfer stages, said number of energy transfer stages being at least two.

In embodiments, the apparatus comprises a number of energy transfer stages arranged in parallel and/or in series.

In embodiments, in said apparatus, the distance between the energy transfer stages defined as a distance between the row of stationary diffuser vanes of a first energy transfer stage and the row of stationary nozzle guide vanes of a second energy transfer stage successive to the first energy transfer stage is variable.

In embodiments, the distance between the energy transfer stages is made variable based on required flow conditions, such as a level of mixing and/or a pressure level.

In embodiments, the at least one row of stationary diffuser vanes of a first energy transfer stage and the at least one row of stationary nozzle guide vanes of a second energy transfer stage successive to the first energy transfer stage are joined to form a combined blade row, whereby the distance between the first stage and the successive second energy transfer energy transfer stage is set to zero.

In embodiments, the apparatus further comprises at least one stage configured to adjust pressure across a corresponding row of the rotor blades.

In embodiments, in said apparatus, each energy transfer stage and each pressure adjusting stage is/are established, in terms of its' structure and/or controllability over the operation thereof, independently from the other stages.

In embodiments, in said apparatus, the stationary vanes and/or the rotor blades are individually adjustable within each stage, in terms of at least dimensions, alignment and spatial disposition thereof, during the operation of the apparatus.

In embodiments, the apparatus comprises rotor blade rows having blade radius configured variable stagewise, optionally in a direction from the inlet to outlet.

In embodiments, in said apparatus, at least one inlet or a stage comprising the at least one inlet is configured to receive the stream of fluidic medium through a radial-to-axial transition duct or a number of circumferential sectors or pipes with different axial, radial or circumferential inlet velocity components.

In embodiments, at least one outlet or a stage comprising the at least one outlet is configured as a circumferential volute with at least one pipe and/or with an axial, radial or circumferential duct.

In embodiments, the apparatus further comprises a turboexpander device arranged downstream of a last energy transfer stage.

In embodiments, the apparatus is configured electrically operated by virtue of being driven by at least one electric drive engine.

In embodiments, the apparatus further comprises a cooling arrangement optionally together with temperature resistant coatings and/or components made of temperature resistant materials.

In embodiments, the apparatus is further provided with a number of catalytic surfaces and/or catalytic elements.

In another aspect, use of said apparatus in generation of the fluidic medium heated to the temperature essentially equal to or exceeding about 500 degrees Celsius (° C.), is provided, according to what is defined in the independent claim 32. In embodiments, the use is provided in generation of the fluidic medium heated to the temperature essentially equal to or exceeding about 1000° C., preferably, to the temperature essentially equal to or exceeding about 1400° C., and still preferably, to the temperature essentially equal to or exceeding about 1700° C.

In embodiments, the use is provided, wherein the temperature rise achievable per an energy transfer stage is within a range of 10-1000° C. depending on the fluidic medium.

In a further aspect, an assembly comprising at least two rotary apparatuses according to the embodiments is provided. In embodiments, the apparatuses are at least functionally connected in parallel or in series. In embodiments, said at least two apparatuses are connected such as to mirror each other, whereby their shafts are at least functionally connected.

In a further aspect, an arrangement comprising at least one rotary apparatus according to the embodiments connected to at least one heat-consuming unit is provided. In embodiment, the heat-consuming unit is any one of: a furnace, an oven, a kiln, a heater, a burner, an incinerator, a boiler, a dryer, a conveyor device, a reactor device, or a combination thereof.

In a further aspect, a heat-consuming system configured to implement an industrial heat-consuming process and comprising at least one rotary apparatus according to the embodiments is provided.

In embodiments, the industrial heat-consuming process is selected from the group consisting of: steel manufacturing; cement manufacturing; production of hydrogen and/or synthetic gas, such as steam-methane reforming; conversion of methane to hydrogen, fuels and/or chemicals; thermal energy storage, such as high temperature heat storage; processes related to oil- and/or petrochemical industries; catalytic processes for endothermic reactions; processes for disposal of harmful and/or toxic substances by incineration, and processes for manufacturing high-temperature materials, such as glass wool, carbon fiber and carbon nanotubes, brick, ceramic materials, porcelain and tile.

In still further aspect, a method for inputting thermal energy into a fluidic medium is provided .

Utility of the present invention arises from a variety of reasons depending on each particular embodiment thereof.

Overall, the invention offers a rotary fluid heater aiming at maximizing (and rising) the work input within energy consuming machinery. The apparatuses and methods according to the present disclosure allow for heating fluids, such as gases, to high- and extremely high temperatures, such as temperatures generally exceeding 500° C., in cost- and energy-efficient manner. In the inventive concept, the rotary apparatus can be used to replace conventional fired heaters or process furnaces for direct or indirect heating in different heat-consuming process applications.

The rotary apparatus according to the embodiments thus enables heating of fluidic substances to the temperatures within a range of about 500° C. to about 2000° C., i.e. the temperatures used in a wide range of industrial applications, including, but not limited to production of bulk chemicals, manufacturing of steel and non-metallic minerals, oil processing and refinement, and others heat-consuming processes. Heating of fluids to the range of extremely high temperatures is achieved by employing advanced cooling technologies in realization of the apparatus solutions proposed herewith.

Moreover, the rotary apparatus of the present invention can be configured as an electrified heater solution. Benefits of using electrified heater solutions include elimination or at least significant reduction of greenhouse gas emissions (such as NO, $CO_2$, CO, $NO_X$) and other harmful components (such as HCl, $H_2S$, $SO_2$, heavy metals, particle emissions) originating from burning the non-renewable fuels in conventional fired heaters.

The rotary apparatus allows electrified heating of fluids to temperatures up to 1700-2000° C. and even higher. Such temperatures are difficult or impossible to reach with current electrical heating applications.

The rotary apparatus presented herewith can be used for direct heating of various fluids, such as process gases, inert gases, air or any other gases or for indirect heating of fluids (liquids, vapor, gas, vapor/liquid mixtures etc.). Heated fluid generated in the rotary apparatus can be used for heating of any one of gases, vapor, liquid, and solid materials. The rotary apparatus can at least partly replace—or it can be combined with (e.g. as a pre-heater) multiple types of furnaces, heaters, kilns, gasifiers, and reactor devices that are traditionally fired or heated with solid, liquid or gaseous fossil fuels or in some cases bio-based fuels.

By virtue of its flexible design and compactness combined with capability to achieve a wide range of high temperatures in short time periods, the rotary apparatuses and related assembles can be used in a variety of industrial applications ranging from steel manufacturing to high temperature heat storage. The invention further enables a reduction in the on-site investment costs as compared to traditional fossil fired furnaces.

The proposed apparatus solution is also fully scalable; the disclosed apparatus can be configured for use in a heat-consuming industrial facility of essentially any size and capacity. By scalability we refer to modifying the size of an individual apparatus and its capacity, accordingly. In general, scalability of the apparatus is proportional to its power requirements and/or a shaft-/rotor speed.

Moreover, by means of the proposed apparatus solution, significantly improved work input capability can be achieved, which is about ten times higher when compared to conventional compressor devices.

The expression "a number of" refers hereby to any positive integer starting from one (1), e.g. to one, two, or three. The expression "a plurality of" refers hereby to any positive integer starting from two (2), e.g. to two, three, or four. The terms "first" and "second", are used hereby to merely distinguish an element from another element without indicating any particular order or importance, unless explicitly stated otherwise.

The term "gasified" is utilized herein to indicate matter being converted into a gaseous form by any possible means.

The term "hydrodynamic" is utilized herein to indicate the dynamics of fluids, which are, in this disclosure, largely represented by gases. In present disclosure the term "hydrodynamic" is thus utilized as a synonym to the term "aerodynamic", unless explicitly indicated otherwise.

Different embodiments of the present invention will become apparent by consideration of the detailed description and accompanying drawings.

DETAILED DESCRIPTION OF THE EMBODIMENTS

Figure 1A:
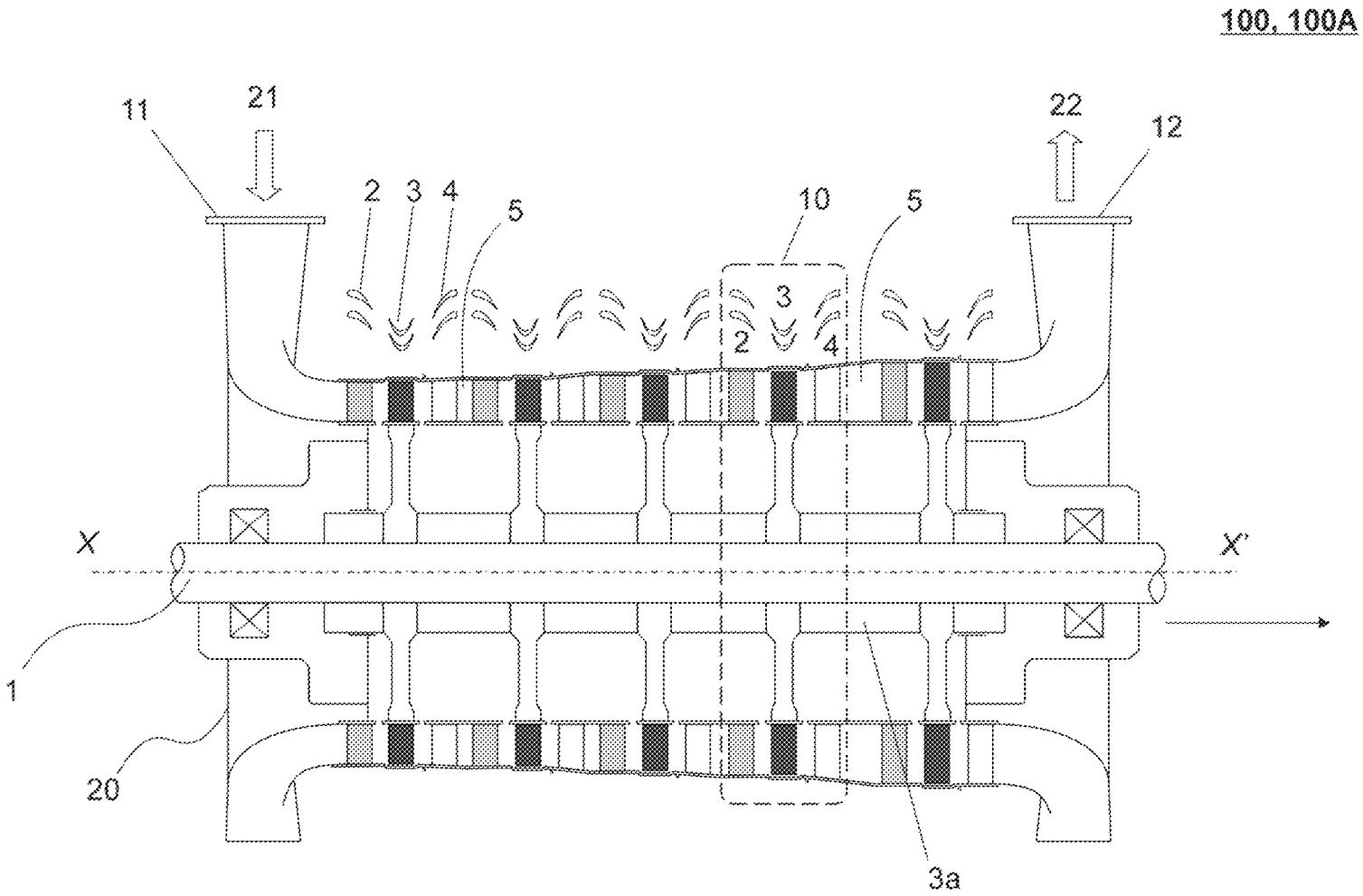
FIG. 1A. schematically illustrate an apparatus 100 implemented in accordance with an embodiment.

Detailed embodiments of the present invention are disclosed herein with the reference to accompanying drawings. The same reference characters are used throughout the drawings to refer to same members.

FIG. 1A schematically illustrates, at 100A, an exemplary embodiment underlying a concept of a rotary apparatus 100, hereafter, an apparatus, for inputting thermal energy into fluids.

Overall, the apparatus 100 is configured to implement fundamental energy conversion principles of turbomachines, that are very efficient means for transferring mechanical energy to the fluid. The apparatus according to the present disclosure efficiently transfers the mechanical energy of rotating shaft to fluidic media and converts it into internal energy of the fluid by virtue of a set of stationary- and rotating blade rows.

Realization and operating principle of the apparatus 100 will be further explained using configuration 100A shown on FIG. 1A. Alternative and/or supplementary modifications of the apparatus 100 will be explained throughout the description.

The apparatus 100 comprises a rotor shaft 1, also referred to as a central shaft, disposed along a horizontal (longitudinal) axis (X-X'). A rotor comprising at least one row of rotor blades 3 arranged over a circumference of a rotor hub 3*a* is mounted onto the rotor shaft 1. In some configurations, the at least one row of rotor blades can be implemented as a separate rotor unit. Such rotor unit comprises a plurality of rotor blades arranged over a circumference of a rotor disk.

The apparatus can be implemented with a single row of rotor blades or with a single (separate) rotor unit. Alternatively, the apparatus can comprise more than one blade rows successively arranged on a common rotor hub or it can be implemented with a number of separate rotor units mounted onto the rotor shaft in sequential order (one after another).

In embodiments, the apparatus comprises at least two rows of rotor blades successively arranged on the rotor shaft. Implementations with 2-10 rows of rotor blades/separate rotor units mounted onto the rotor shaft can be conceived.

Figure 8:
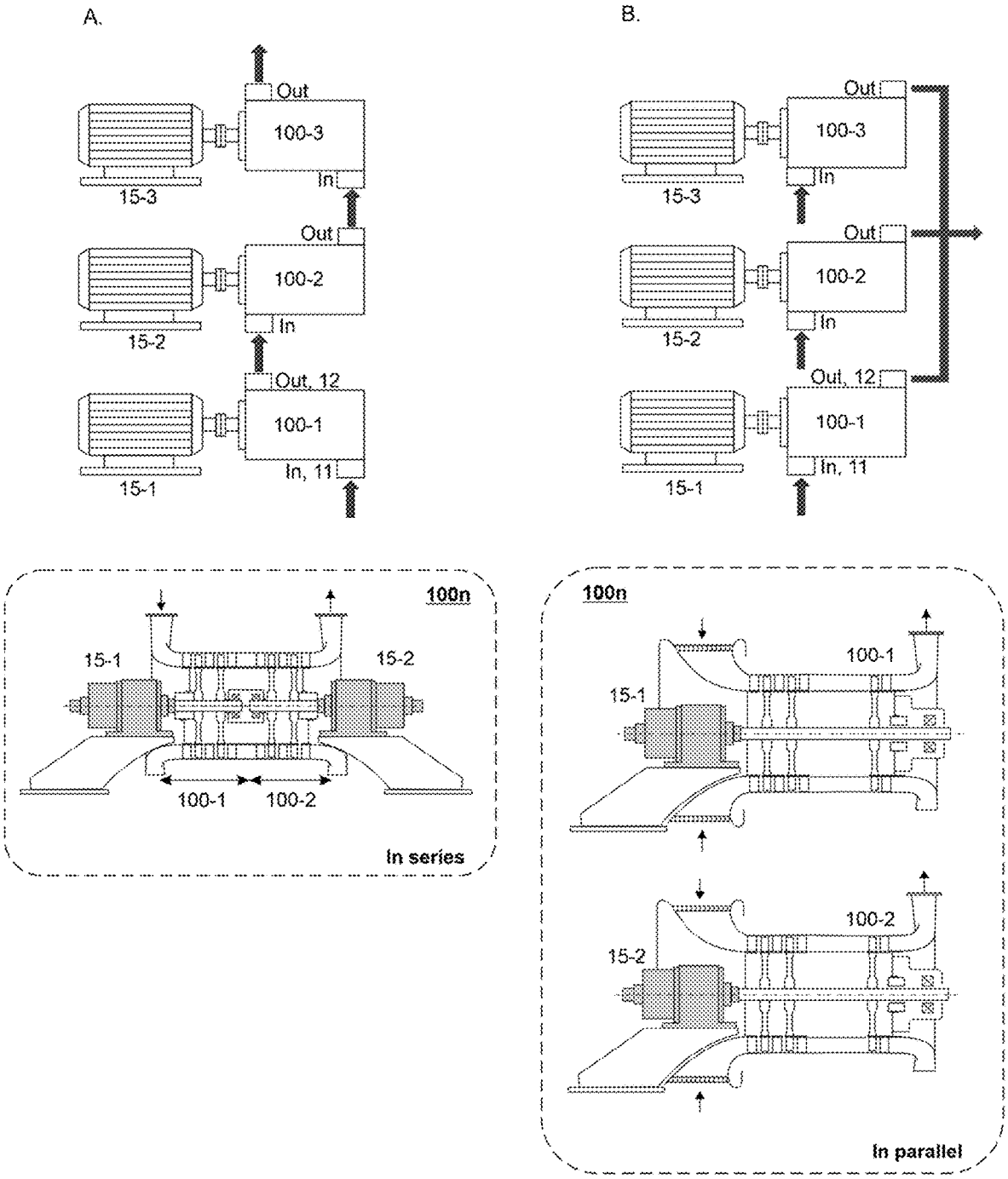
FIG. 8 shows the apparatus 100 implemented with a single- and multiple shaft configurations and an assembly 100*n* comprising at number of apparatuses 100.

The apparatus 100 further comprises at least one drive unit (15, rf. FIG. 8). The drive unit comprises at least one drive engine configured to rotate the shaft and the rotor blades arranged on the rotor hub and/or rotor disk(s). In embodiments, the apparatus is configured electrically operated. In embodiments, the at least one drive engine is an electric motor optionally combined with or replaced by any one of gas- or steam turbine, for example. Any other appropriate drive device can be utilized. For the purposes of the present disclosure, any appropriate type of electric motor (i.e. a device capable of transferring energy from an electrical source to a mechanical load) can be utilized. Suitable coupling(s) arranged between a motor drive shaft and the rotor shaft, as well as various appliances, such as power converters, controllers and the like, are not described herewith.

The rotor thus comprises a plurality of rotor blades 3 arranged into at least one row and configured as impulse impeller blades. A plurality of rotor blades arranged into the at least one blade row can be alternatively viewed as an (annular) rotor blade assembly or a rotor blade cascade.

The apparatus 100 further comprises at least one row (cascade) of stationary or stator blades 2 arranged upstream of the at least one row of the rotor blades 3, and at least one row (cascade) of stationary blades 4 arranged downstream of the at least one row of the rotor blades 3. For clarity, the rows 2, 4 of stationary blades are further referred to as (stationary) vanes. The stationary rows of vanes 2, 4 are provided as essentially annular assemblies upstream- and downstream of the at least one row of rotor blades 3, respectively. In an event the apparatus 100 comprises more than one row of rotor blades 3, each said row of rotor blades is disposed between the rows of stationary blades/vanes 2, 4, respectively.

The "upstream" row(s) of stator vanes 2 is/are preferably composed of a plurality of stationary guide vanes. The "downstream" row(s) of stationary vanes 4 is/are preferably composed of a plurality of stationary diffuser vanes.

Figure 4:
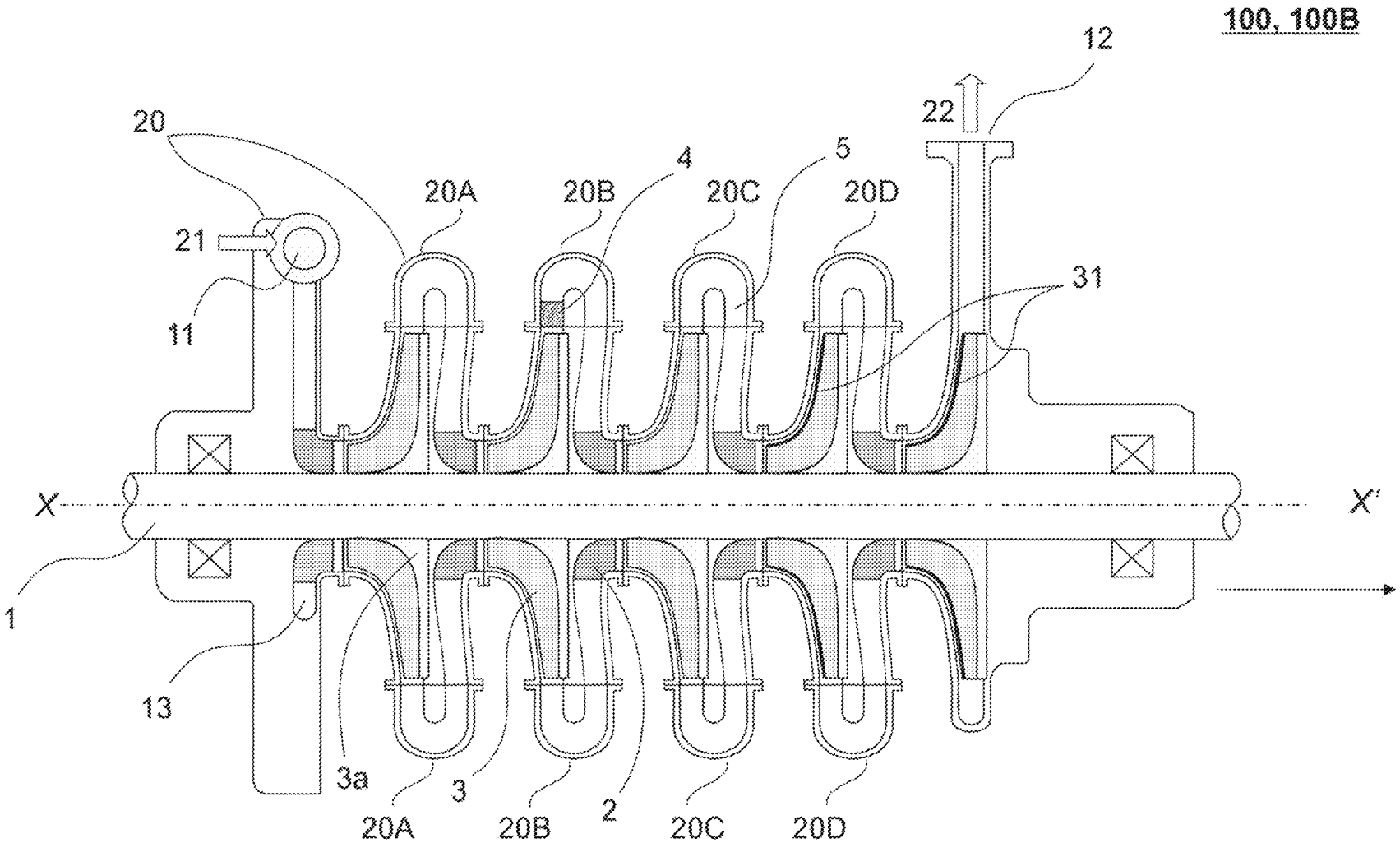
FIGS. 4 and 5 show the apparatus 100, implemented in accordance with some embodiments.
Figure 5:
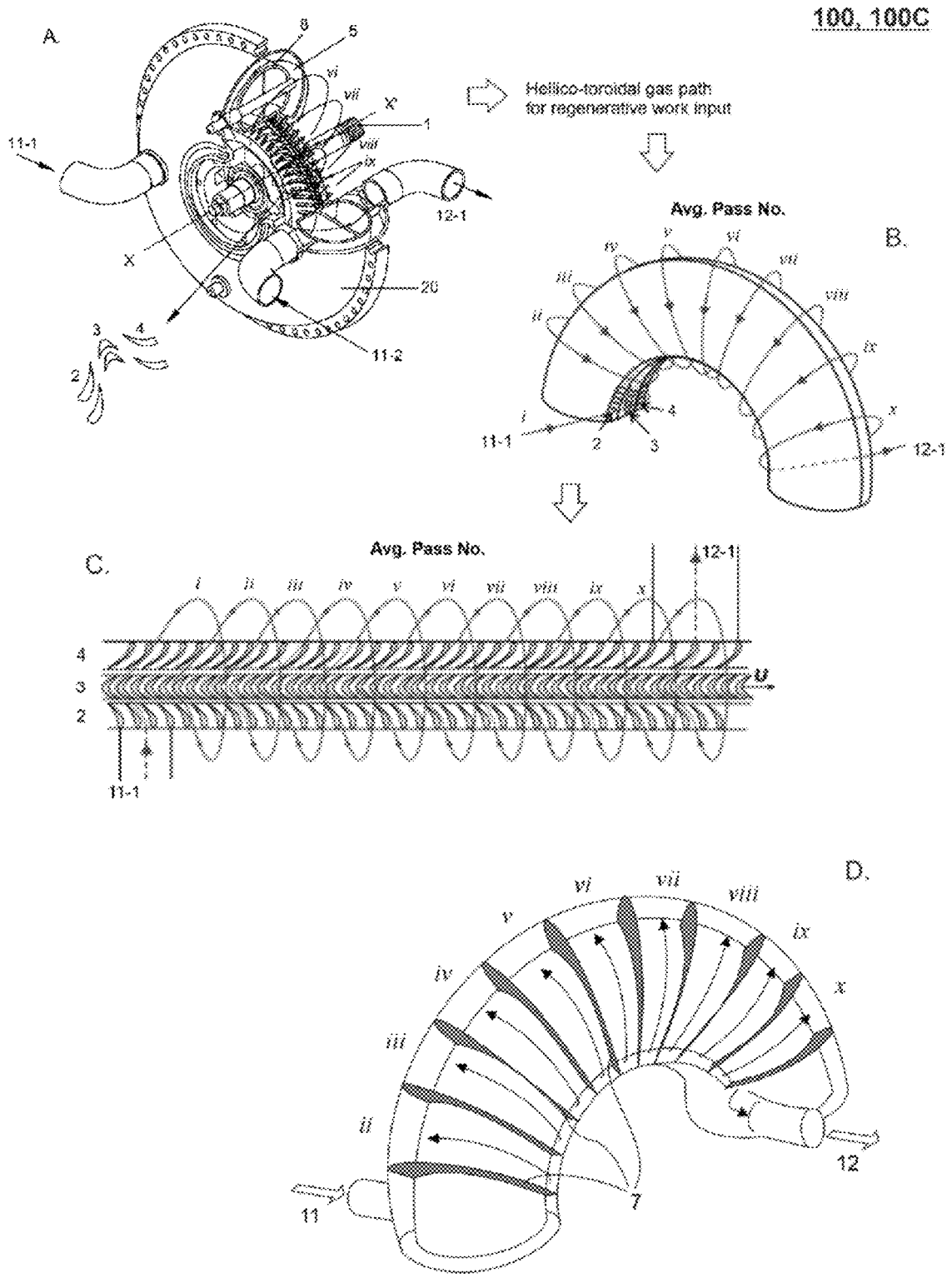

The terms "upstream" and "downstream" refer hereby to spatial and/or functional arrangement of structural parts or components with relation to a predetermined part- or component, hereby, the rotor, in a direction of a fluidic medium flow throughout the apparatus 100 from inlet to exhaust. In some embodiments, the flow follows a direction along the horizontal rotor shaft axis (X-X'), as indicated on FIGS. 1A, 4 with an arrow. In some other embodiments, the flow follows more complex pathways (rf. FIG. 5, for example).

Figure 1B:
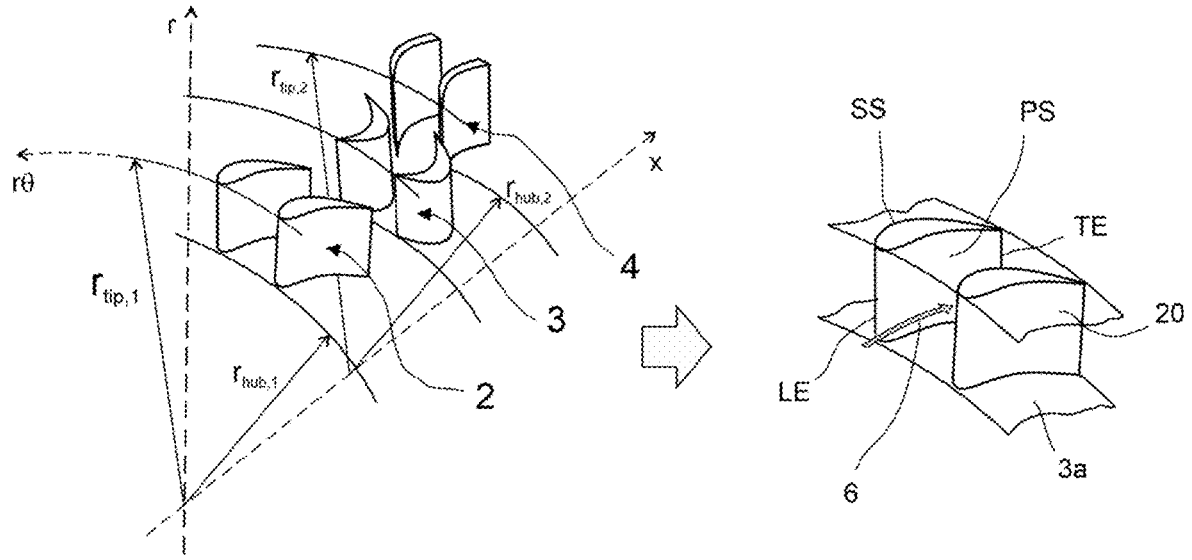
FIG. 1B illustrates an arrangement of stationary- and rotating blade rows within the apparatus 100.

A stator-rotor-stator (stator-rotor-diffuser) arrangement 2, 3, 4 composed of stationary (2, 4) and rotating (3) blade rows is illustrated on FIG. 1B (left). Each blade row is formed of a plural number of blades (the latter are also referred to as "vanes" with regard to the stationary components). Any one of said blades/vanes (2, 3, 4) is formed by a shell extending from a root section to a tip section at different and variable radius. Root-to-tip radius ratio (also referred to as hub-to-tip radius ratio for rotating blades) and/or blade angle(s) is/are configured variable to guide fluid(s) along a flow path required/desired in each particular implementation of the apparatus 100. The blade/vane rows 2, 3, 4 can thus be configured to implement any one of axial, radial or diagonal flow paths, or a combination thereof (in multistage configurations, for example).

The shell has two sides (pressure side, PS and suction side, SS) with a defined thickness distribution between them and having the side surfaces joined at a blade entrance (blade inlet) by a leading edge (LE) and at a blade exit by a trailing edge (TE) with symmetric and non-symmetric shapes. The rotor blades are attached (with its hub portion) to the rotor hub/rotor disc (a hub surface is designated with a reference numeral 3*a*); while the stationary vanes are typically attached, directly and/or indirectly, to a casing surface (designated with a reference numeral 20). A passage between the pressure side and the suction side of adjacent blades is designated by a reference numeral 6.

Blade/vane design depends on realization of the apparatus 100. Variable parameters include the shape of the blade (at PS and/or SS), airfoil profile, blade inlet- and the blade exit angles, the root-to-tip radius ratio, spacing between consecutive blades (pitch), and the like. By altering these parameters, a variable passage channel geometry between the adjacent blades is created in order to achieve required/desired pressure and/or temperature conditions within the fluid. The space (passage 6) between any one of the blade/vanes rows 2, 3 or 4, or between all indicated blade rows can be adjusted as required for flow conditioning purposes.

The reference is made back to FIG. 1A. In the apparatus 100, a (three-dimensional) space 5 separates the rows of stationary vanes 2, 4 from one another. In optional configurations, the space 5 may comprise a number of additional devices, such as flow shaping-/flow guide appliances, which can be configured as guidewalls, for example, to partition the flow path and create individual passes therein. Configuration with guidewalls 7 and a flow-shaping device 8 is presented on FIG. 5 described in detail further below. In embodiments, the space 5 is vaneless.

The apparatus 100 further comprises a casing or a housing 20 with at least one inlet 11 through which the fluidic medium to be processed (heated) enters the apparatus (feed 21), and at least one outlet (exit) 12 through which the processed (heated) stream of fluidic medium 22 is discharged from the apparatus. The inlet(s) and outlet(s) comprise a related opening/port in the casing 20 and pipes, sleeves or manifolds associate with each said port. The casing 20 is configured to enclose the rotor shaft 1 with the at least one row of rotor blades. The rows of stationary vanes 2, 4 are arranged inside the casing and can be fixed on an interior side of the casing directly and/or indirectly. The stationary vanes can thus be fixed directly on a wall that defines the interior of the apparatus 100 and/or connected thereto by means of the auxiliary arrangements, such as rings, brackets, and the like.

Overall, the apparatus 100 implemented in accordance with different embodiments of the present invention is configured to impart an amount of thermal energy (heat) to a stream of fluidic medium directed along a flow path formed inside the casing 20 between the inlet 11 and the outlet 12. The amount of thermal energy is imparted to the fluid by virtue of a series of energy transformations occurring when said stream of fluidic medium successively passes through the blade/vane rows formed by the stationary guide vanes 2, the rotor blades 3 and the stationary diffuser vanes 4, respectively, in a direction a fluid flow from the inlet 11 to the outlet 12.

The successive blade/vane rows 2, 3 and 4 are thus configured to produce conditions, at which an amount of kinetic energy added to the stream of fluidic medium by rotating blades of the rotor is sufficient to raise the temperature of the fluidic medium to a predetermined value when said stream of fluidic medium exits the row of rotor blades at a supersonic speed and passes through the at least one row of diffuser vanes, where the stream decelerates and dissipates kinetic energy into an internal energy of the fluidic medium, and an amount of thermal energy is added to the stream of fluidic medium.

When the stream of fluidic medium propagates through the rotary apparatus 100, the amount of thermal energy added to fluid is produced by virtue of generation of shock trains during successive propagation of the stream through the sequential blade/vane rows 2, 3 and 4 (2-3-4) in a controlled manner. A shock train is a three-dimensional system of multiple shocks/shock waves that decelerates the flow arriving (from the rotor 3) at a supersonic speed. While formation of shock trains and actual energy conversion occur essentially upon propagation of the fluid flow through the diffuser 4, the flow is rendered supersonic upon propagating through the rotor 3; and the stationary guide vanes 2, in turn, prepare the flow for entering the rotor at a required direction/angle.

In embodiments, the rotary apparatus 100 is configured to implement a fluidic flow, between the inlet and the outlet, along an essentially axial flow path. In some other embodiments, the apparatus 100 can be configured to implement the fluidic flow, between the inlet and the outlet, established in accordance with any one of: an essentially helical trajectory formed within an essentially toroidal-shaped casing, as discussed in any one of the patent documents U.S. Pat. No. 9,494,038 to Bushuev and U.S. Pat. No. 9,234,140 to Seppala et al; an essentially helical trajectory formed within an essentially tubular casing, as discussed in the patent document U.S. Pat. No. 9,234,140 to Seppala et al; an essentially radial trajectory as discussed in the patent document U.S. Pat. No. 10,744,480 to Xu & Rosic; and along the flow path established by virtue of the stream of fluidic medium in the form of two spirals rolled up into vortex rings of right and left directions, as discussed in the patent document U.S. Pat. No. 7,232,937 to Bushuev).

In the apparatus 100, the row of stationary guide vanes 2, the row of rotor blades 3 and the row of stationary diffuser vanes 4 establish an energy transfer stage 10, also referred to as an elemental stage or a working stage (hereafter, a stage). The stage 10 is designated on FIG. 1A by a dashed box and is shown in more detail on FIG. 1C.

The function of the elemental stage is to impart the mechanical energy to the fluid and convert it into the thermal energy. The stage is thus configured to mediate a complete energy conversion and energy transfer cycle. The fluidic medium undergoes heating as it flows through the at least one stage formed with successive rows 2, 3 and 4 (the "stator-rotor-stator" arrangement 2-3-4).

During the energy conversion/energy transfer cycle, the stationary guide blade row(s) 2 disposed upstream the rotor blades 3 prepare the required flow conditions at the entrance of the rotating blade row. In the rotor blade row, mechanical energy of the shaft and rotating blades is transferred to fluidic stream. In at least the part of each rotor blade row 3 the flow of fluidic medium can reach a supersonic flow condition.

The stationary blade row(s) (aka diffuser 4) disposed downstream the rotor blades 3 convert(s) mechanical energy of the fluidic medium into its thermal energy. The fluidic flow exits the rotor blades 3 and enters the diffuser 4 at supersonic speed. If the flow upstream of the diffuser is supersonic, the kinetic energy of the fluidic stream is converted into internal energy of the fluid through a system of multiple shocks and viscous mixing and dissipation. The flow dissipates its kinetic energy into internal energy of the fluidic stream propagating through the apparatus and thus provides the amount of thermal energy to the fluid. An increase in the internal energy of the fluid results in a rise of fluid temperature.

Efficient heating of fluids passing through the apparatus 100 are achieved with the following blade/vanes configurations.

In embodiments, the rotor blades 3 are configured, upon rotation of the rotor, to receive the stream of fluidic medium from the stationary vanes 2 and to accelerate said stream to a supersonic speed thus imparting mechanical energy to the process fluid by increasing tangential velocity thereof. Overall, the rotor blades 3 are configured as ultra-highly loaded impulse impeller blades for high stage work input. Energy conversion rate is ultra-high in an impulse impeller, resulted from multiplication of high relative speeds at the entrance to and exit from the rotor blade row(s) with large tangential velocity components and the blade speed.

Figure 1C:
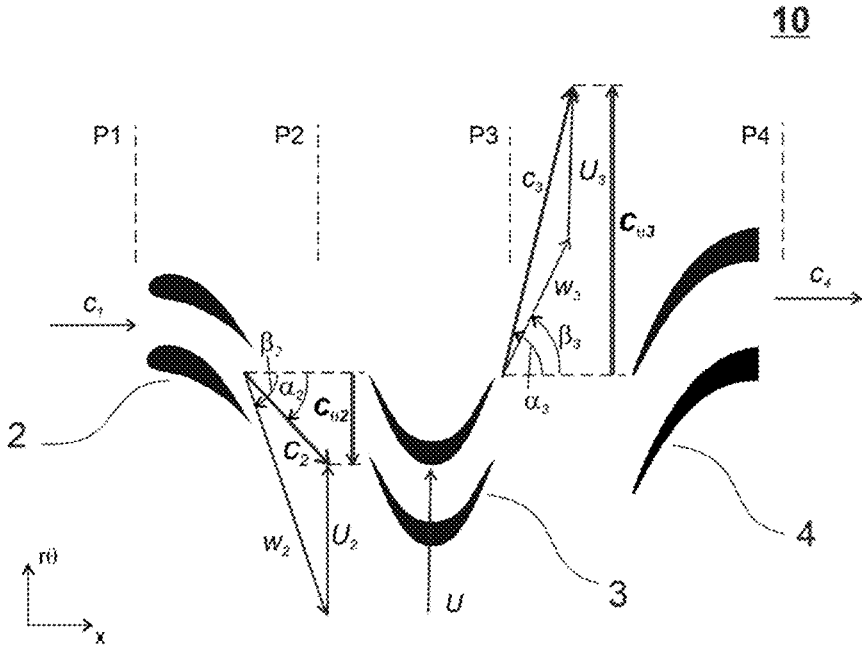
FIG. 1C schematically illustrates velocity triangles at a rotor blade entrance and exit within an energy transfer stage.

Reference is made to FIG. 1C, which schematically illustrates velocity triangles at the rotor blade entrance (drawn in plane 2; P2) and the rotor blade exit (drawn in plane 3, P3) within a single (elemental) stage. The following designations are adapted for the members:

C—absolute flow velocity (m/s)
W—relative flow velocity (m/s)
U—circumferential speed of the blade (m/s)
α (alpha)—absolute flow angle (deg)
β (beta)—relative flow angle (deg)
x—axial direction
r—radial direction
θ (theta)—circumferential direction Designations P1-P4 are used for geometrical planes (x, r, θ) at the stage entrance (P1; at the stationary guide vanes 2 inlet with a flow component $C_1$; at the stage exit (P4; at the stationary diffuser vanes 4 exit; flow component $C_4$); at the rotor inlet (P2, flow components $C_2$, $W_2$, $U_2$) and at the rotor exit (P3, flow components $C_3$, $W_3$, $U_3$). Corresponding subscripts 1-4 are utilized. Velocity triangles drawn at planes 2 and 3 are also indicative of flow parameters at the exit from the stationary guide vanes 2 and at the entrance to the stationary diffuser vanes 4, respectively. Indications $C_{\theta 2}$ and $C_{\theta 3}$ designate circumferential components of absolute velocity at the rotor inlet and exit. The blade rows 2, 3, 4 are advantageously designed such, as to create a large change in absolute circumferential (swirl) velocities at the rotor inlet and the rotor exit (note vectors $C_{\theta 2}$ ad $C_{\theta 3}$).

Relationship between absolute- and relative velocities is generally defined as:

$$C=W+U$$

The apparatus 100 operates within a range of velocities (U) between about 150-300 meter per second (m/s), for example. Other (lower or higher) velocities or ranges of velocities are not excluded. For example, the rotor blade (tip) speed (U) within a value range of about 300-400 m/s can be achieved. The above values are given for illustrative purposes and are not to be considered as limiting. The rotor speed and the flow velocity, accordingly, can vary depending on the fluidic medium, process temperature, materials forming the apparatus 100, and other parameters.

In embodiments, the stage is configured such that the flow enters and exits the rotor blades at an angle- or a range of angles designed to maximize the energy input to the fluid. This is illustrated by FIG. 10 showing a graph for energy transfer coefficient distribution across possible design parameter ranges with a varying flow coefficient and a range of rotor blade metal angles (χ, chi) at the rotor blade inlet, wherein the flow coefficient (ϕ, phi) is defined as:

$$\phi=C_x/U$$

wherein $C_x$ designates the axial component of absolute velocity.

Figure 10:
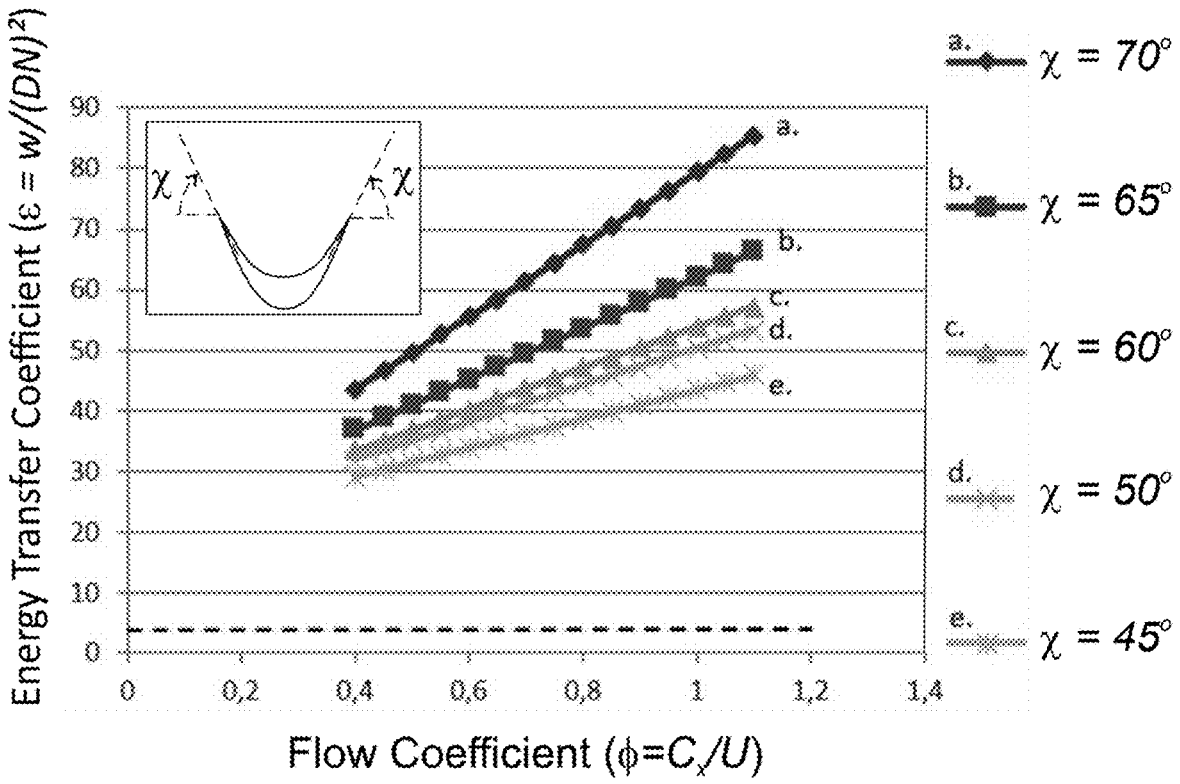
FIG. 10 is a graph for energy transfer coefficient distribution across possible design parameter ranges with a varying flow coefficient and a range of rotor blade metal angles at a rotor blade inlet.

The graph shown on FIG. 10 covers a wide range of the rotor tip speed (circumferential speed, U) from 160 m/s to 280 m/s. The apparatus can be operated also in a wider speed range when different energy conversion rates are required, depending on operation conditions.

An energy transfer coefficient (ε) is defined as:

$$\varepsilon = \frac{W}{\dot{m}(DN)^2} = \frac{w}{(DN)^2}$$

where W is the total energy transferred from the device to the fluid, w is the specific (energy per unit mass) energy transferred, ṁ the mass flow rate through the apparatus 100, D is the outer diameter of the rotor, and N is the rotor rotating speed (RPS, revolution per second).

The achievable energy transfer coefficients (as per the energy transfer stage of the apparatus 100) are compared to a value that is equivalent to a conventional highly-loaded gas turbine compressor stage (shown in dotted horizontal line in the lower part of the graph).

FIG. 10 clearly demonstrates that increasing the rotor blade metal angle (χ) results in higher levels of energy transfer (from the apparatus to the fluids). In order to maximize the energy input (per stage), an advantageous distribution of metal angles at the rotor inlet and exit includes a range of about 45 to 75 degrees, in some configurations—a range of about 60 to about 70 degrees. In some configurations, the metal angles at the rotor inlet and exit are essentially the same (including 1-10 deg variability margin).

It should be further noted that for a rotor blade, the inlet metal angle essentially corresponds to the relative inlet flow angle (rf. $\beta_2$, FIG. 1C), while its exit metal angle essentially corresponds to the relative exit flow angle (rf. $\beta_3$, FIG. 1C). For a stator blade (stationary guide vane), the inlet metal angle (not shown) essentially corresponds to the absolute inlet flow angle (rf. $\alpha_2$, FIG. 1C), while its exit metal angle essentially follows from a turning pathway required to align the fluidic flow with the downstream rotor leading edge and to direct the flow to the rotor blade inlet (rf. β2, FIG. 1C).

The above described configurations allow for improved work input capability of the apparatus 100 (>10 times better work input per stage as compared to conventional compressor devices).

With reference back to FIG. 1C, the at least one row of rotor blades 3 receives the flow entering from any one of the axial, diagonal and radial direction, or a combination thereof (e.g. from axial-radial direction). Typically, the rotor hub 3 and the casing 20 indirectly define the flow direction; therefore, direction of the flow can also be regulated by modifying the apparatus 100. Modification can be done by simple up-and down-scaling and/or by implementing the apparatus 100 in different realizations, as explained further below.

The rotor blade row(s) 3 thus receive(s) the stream of fluidic medium entering from any one of the axial-, diagonal- or radial directions and cause changes in flow velocity (absolute flow velocity) such that the stream of fluidic medium is accelerated at least two-fold.

Overall, in the apparatus 100 described herewith, the rotor is configured, in terms of profiles and dimensions of the rotor blades and disposition thereof on the rotor hub/rotor disk, to maximize and optionally to control mechanical energy input into the stream of fluidic medium.

Figure 1D:
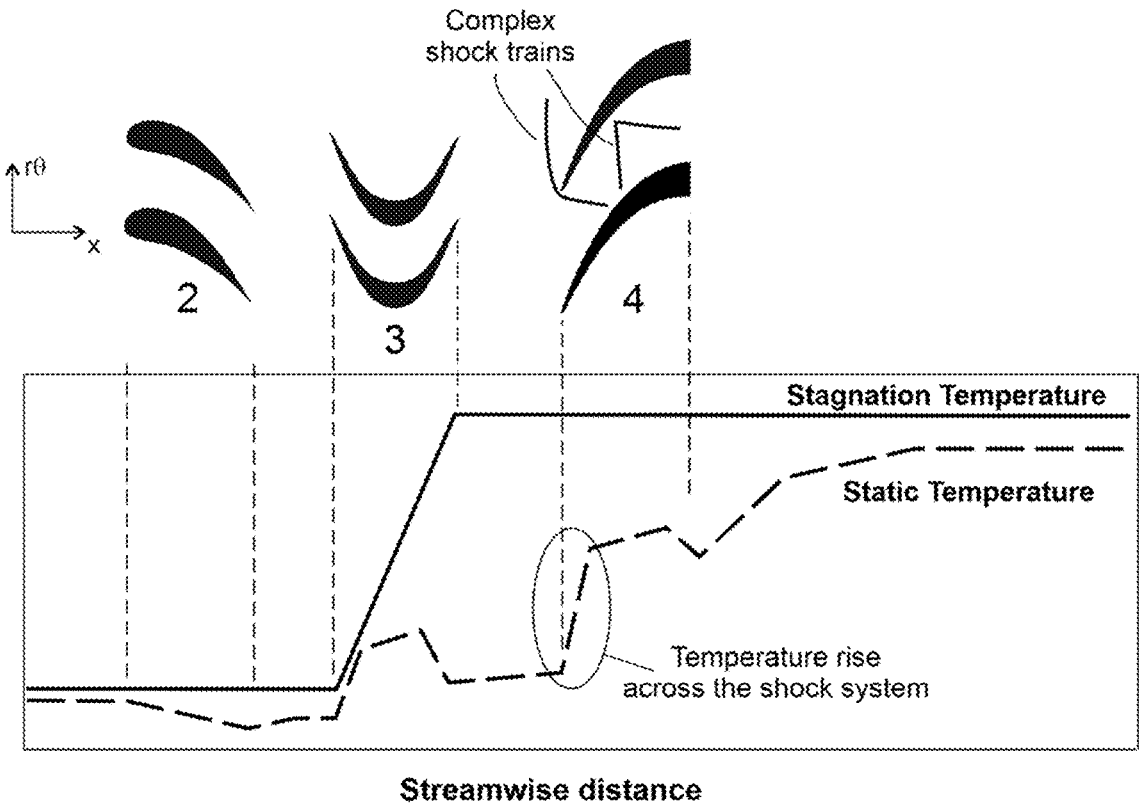
FIG. 1D schematically illustrates formation of shock trains and temperature rise across the shock system upon propagation of fluid through successive blade rows in the apparatus 100, according to the embodiments.

Events occurring when fluidic medium passes through the elemental stage (2, 3, 4), in particular, through the row of rotor blades 3 and the row of diffuser vanes 4 are schematically illustrated on FIG. 1D. When the flow exits the ultra-highly loaded impulse impeller 3 at a supersonic speed, an amount of (mechanical) energy is transferred from the rotating shaft and rotor blades to the surrounding medium. In the diffuser blade row 4, the energy transformation occurs, as described above, through formation of a complex system of shock trains and energy dissipation, whereby the (static) temperature of the fluid rises across the shock system (a sharp slope marked with a circle). Stagnation temperature is given as a reference. Values for stagewise temperature changes are provided hereinbelow. By way of example, an average temperature change, hereby, temperature rise, for a typical elemental stage is accompanied with the change in the enthalpy (stage-specific work input) of about 300 kJ/kg.

In comparison with known turbomachines and turbomachine-type devices, the apparatus 100 aims at maximizing the work input, optionally the work input per stage, within an energy consuming machine. As mentioned above, the state-of-art compressor devices, for example, demonstrate about ten times lower work input per stage, in comparison with the apparatus 100 according to the embodiments.

By means of the apparatus 100 it is possible to impart the amount of thermal energy to a variety of fluids/fluidic media in relatively short temporal periods to heat the fluid to temperatures essentially equal to- or exceeding 500 degrees Celsius (° C.). In embodiments, the apparatus 100 can thus be used to generate fluidic media heated to the temperature essentially equal to or exceeding about 500 degrees Celsius (° C.). In embodiments, the apparatus 100 can be used to generate fluidic media heated to the temperature essentially equal to or exceeding about 1000° C. In further embodiments, the apparatus 100 can be used to generate fluidic media heated to the temperature essentially equal to or exceeding about 1200° C., preferably, to the temperature essentially equal to or exceeding about 1400° C., still preferably, to the temperature essentially equal to or exceeding about 1700° C. Temperatures up to 2000-2500° C. can be achieved.

The apparatus 100, in different configurations, is capable of providing the temperature rise within a range of about 10-1000° C. per energy transfer stage. Exemplary stagewise temperature rise values include 50-100° C., 100-500° C. and 500-1000° C. and/or any value within these ranges. The temperature rise per stage largely depends on the fluidic medium propagated through the apparatus 100 and a technical application area in which the apparatus 100 is expected to be utilized. Aforementioned temperature rise (per stage) can be achieved in less than one millisecond: therefore, heating of the fluid in the apparatus 100 having for example 1-10 energy transfer stages is instantaneous.

The apparatus 100 is thus configured to receive a stream of fluidic medium (feed 21). Overall, the feed 21 can comprise or consist of any fluid, such as liquid or gas, provided as a pure component or a mixture of components. Gaseous feed includes, but is not limited to: inert gases (e.g. air, nitrogen gas, and the like), reactive gases, (e.g. oxygen, flammable gases, such as hydrocarbons), and any other gas, such as (water) vapour, steam, carbon oxide gases (carbon monoxide, carbon dioxide), hydrogen, ammonia, and the like. In embodiments, it is preferred that the stream fluidic medium enters the rotary apparatus 100 in an essentially gaseous form.

The feed can be any one of inert gas, feedstock gas, a process gas, a make-up gas (a so-called replacement/supplement gas), and the like. Selection of the feed depends on a process, where the apparatus 100 is used and indeed on a specific industry/an area of industry said process is assigned to, since the latter imply certain requirements and/or limitations on the selection of feed substance(s).

A number of cooling- and/or thermal protection devices and/or appliances can be further incorporated into the apparatus 100 (and into an assembly/arrangement comprising a number of said apparatuses) to form a cooling- and/or thermal protection arrangement. Efficient cooling is particularly essential when using the apparatus 100 in heating fluids to the temperatures beyond about 900° C. The cooling- and/or thermal protection arrangement comprises internal cooling means (means for guiding cooling fluids within the apparatus, for example), a number of thermal barrier coatings/films, and thermal protection materials.

Thus, the surfaces of the apparatus 100 can be heat-protected by introducing a coolant fluid into internal cavities and/or conduits. This can be also implemented by supplying the coolant fluid through the casing 20 (advantageously implemented as a double-wall casing) and/or through the rows of stationary blades into the internal cavities and/or conduits including the stationary and rotating components. The coolant fluid at a predefined temperature and pressure level is supplied through specially formed channels and plenums within the apparatus 100 to form internal cooling of its components. The cooling fluid can be further delivered in the form of films and cooling jets through set of discrete surface holes or slits.

By supplying the coolant fluid at the predefined temperature and pressure into a rotor disc cavity, the ingress of working fluid into the rotor disc/shaft or bearing space can be prevented. The cooling fluid is discharged into the main flow path through a system of axial and radial seals. Additional coolant flow can be applied within the seal configuration (further described with reference to FIG. 9).

Depending on the apparatus configuration, the feedstock fluid and particular technical application area(s), pressure in the apparatus 100 can be maintained at a level less than about 10 bar, including atmospheric pressure (1.01325 bar/101.325 kPa) and below, or at relatively high-pressure levels of about 10-50 bar (1-5 MPa). Regulating pressure level by means of pressure-adjusting stages is described in detail further below.

A variety of high-temperature thermal barrier coatings could be applied to all or selected internal surfaces of the apparatus 100, in particular, the surfaces being in contact with the (working) fluid in the high temperature zone. For producing fluids heated to extremely high temperatures (those above about 900° C.), thermal barrier materials, such as ceramics and/or ceramic matrix composites can be used. High-temperature ceramic material and composites can be used for manufacturing rotor and stator blades, as well as to construct an internal liner within the casing. Additionally or alternatively, low conductivity materials can be utilized.

Transpiration cooling for all blade rows (2, 3, 4) could be achieved through sintering technologies.

Similar methods could be utilized for thermal expansion control. Large temperature differences across the apparatus 100 could cause large thermal stresses and differential thermal expansion between various components. These could be controlled by applying various cooling methods and/or by providing mechanical protection, such as by virtue of a corrugated outer casing, sliding casing segments, and the like.

It should be emphasized, that the above mentioned cooling/thermal protection technologies have not been previously utilized in cooling of general energy input turbomachinery, such as compressors, for example.

Figure 9:
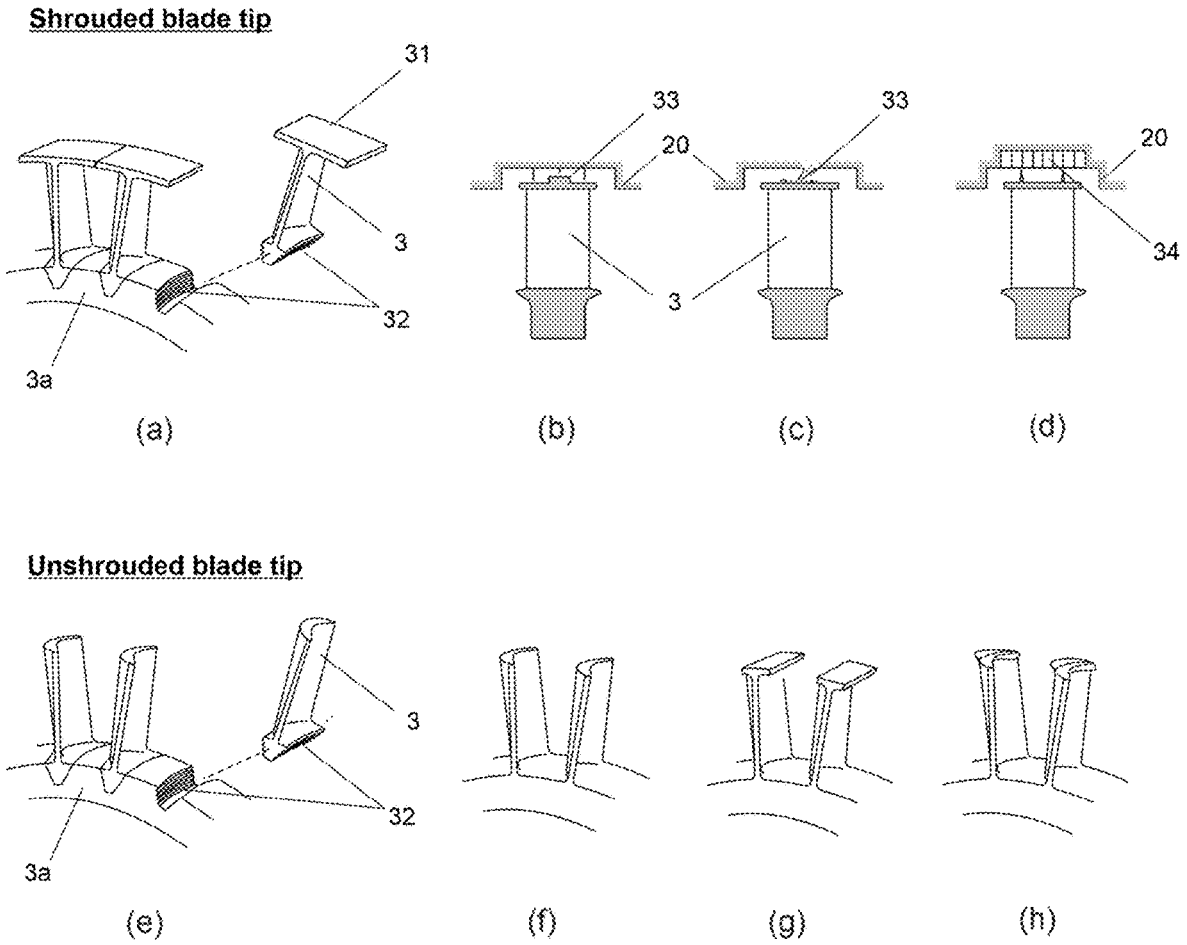
FIG. 9 shows exemplary implementations for shrouded and unshrouded rotor blades.

In some instances, it is preferred that the rotor further comprises a shroud 31 configured to cover a row or rows of the rotor blades 3 (rf. FIG. 9). Examples for shrouded (a-d) and unshrouded/partially shrouded (e-h) rotor blade implementations are summarized on FIG. 10. The shroud 31 protects the tips of rotating blades 3. A fir tree root connector for connecting a rotating blade to the disc/hub 3*a* is designated with the reference number 32. The shroud can be provided as a separate band to cover the tips of individual blades, or the band can be machined to form a continuous shroud cover when assembled. The shroud can further have a single seal or multiple seals, such as radial or inclined seal(s), for example, installed or machined on its top. Said single or multiple (radial or inclined) seals can be further installed or machined in a related casing segment to reduce the leakage flow above the rotor blade row. Shrouded blade with a labyrinth seal and the same with a jet seal are illustrated on FIG. 9(*b, c*), respectively. Any type of seal is indicated with a reference numeral 33. Different forms of honeycombs 34 can be installed within the casing (FIG. 9, *d*). Cooling jets can be used to form a barrier curtain to stop the leakage flow and cool the rotor blade tip (not shown).

Unshrouded rotors tend to be less efficient due to high losses associated with the leakage flow (flow that "leaks" over the uncovered rotating blades), in some instances, the reverse leakage flow. Rotor cover, such as the shroud, effectively prevents or at least minimizes such leakage. Additionally, the shroud prevents fluid backflow and detrimental flow mixing that may otherwise occur between the stages. An unshrouded plain tip is shown on FIG. 9 at (f); a partially shrouded tip solution—at (g), and a blade tip solution with a winglet/squealer geometry tip is shown at (h).

In some instances, the apparatus 100 can comprise both shrouded and unshrouded rotor blade rows. Unshrouded rotors allow for operating the rotor at higher rotational speed, whereby, a configuration with a number of unshrouded rotor blade rows/separate rotor units followed by a number of shrouded ones may be beneficial, in terms of adjusting flow conditions, in particular, in multistage configurations.

The large temperature differences across the apparatus could cause differential radial and axial thermal expansion between stationary and rotating components. This could lead to large axial movements and negative radial clearances between stationary and rotating components. The radial clearances can be controlled by introducing honeycombs and/or various abradable structures and materials, together with the thermal management (cooling or heating) of the casing segments.

The stationary blade row disposed upstream the rotor comprises a plurality of guide vanes configured, in terms of profiles, dimensions and disposition around the rotor shaft, to direct the stream of fluidic medium into the row of rotor blades in a predetermined direction such, as to control and, in some instances, to maximize the rotor-specific work input capability. The guide vanes 2 are advantageously configured as nozzle guide vanes (NGVs). According to established nomenclature, the guide vanes arranged before the rotor blades at a stage containing the inlet port(s)/line(s) 11 are referred to as inlet guide vanes (IGVs), and the same at the stage containing the outlet port(s)/line(s) 12—as outlet guide vanes (OGVs). For clarity purposes, all abovementioned categories of guide vanes are collectively referred to as nozzle guide vanes.

Provided as a stationary structure, the nozzle guide vanes 2 do not add energy to the flow of fluidic media. However, these stator vanes are configured in such a way, as to add necessary/required direction to the flow and to allow the rotor maximizing (mechanical) energy input into the stream of fluidic medium. This is attained by dimensioning the guide vanes such, as to force the fluid to enter the rotor at predetermined and required (by process parameters, for example) flow angle and flow velocity. The angle (rf. β2, FIG. 1C) at which the fluid flow enters the rotor blades (from the axial direction x) can be considered as the most essential parameter hereby, since on that it depends, how much energy the rotor blades 3 will impart to the fluid.

The row of nozzle guide vanes 2 is thus configured as a flow conditioner device that directs the stream of fluidic medium towards the row(s) of rotor blades in a circumferential direction opposite to rotor blade rotation such, as to control the level of energy input from the rotor and the speed of the fluid. The flow conditioner device 2 manages the amount of energy input from the rotating blades and the speed of the fluid entering the rotor.

In embodiments, the nozzle guide vanes are configured with to direct the stream of fluidic medium to enter the row of rotor blades at a range of (relative) flow angles of about 45-75 degrees from axial direction x (rf. β2, FIG. 1C, angles at which a relative fluid flow enters the rotor blade row from the axial direction x).

The stationary blade row disposed downstream the rotor blades and comprising a plurality of diffuser vanes 4 is thus configured as an energy converter device, that converts mechanical energy of the fluidic medium into its thermal energy. In the diffuser vanes, the (supersonic) stream of fluidic medium decelerates, through formation of shock trains, and dissipates kinetic energy into an internal energy of the fluidic medium, whereby the internal energy of said fluidic medium increases and the amount of thermal energy is added to the fluid.

FIGS. 1B and 1D illustrate a principle of energy transformation occurring within the elemental stage 10. In functions terms, the flow conditioner (stationary guide vanes 2) manages (conditions) the flow upstream the rotating blades. The impulse impeller blades 3 impart mechanical energy to the fluid, whilst the energy converter (stationary diffuser vanes 4) enables the internal energy increase in the fluidic medium through the complex system of shocks/shock(wave) trains and (energy) dissipation.

In the apparatus 100, the rows of stationary vanes 2, 4 are preferably arranged in such a way that the three-dimensional space 5 is formed between an exit from the at least one row of stationary diffuser vanes 4 and an entry into the at least one row of stationary guide vanes 4.

In embodiments, the space 5 is variable. The space 5 can be made variable in terms of its dimensions, i.e. in terms of at least size and shape. By varying/adjusting the space 5 formed between an exit from the at least one row of stationary diffuser vanes 4 and an entrance to the at least one row of nozzle guide vanes 2 in a direction of the flow path formed inside the casing 20 between the inlet 11 and outlet 12, the amount of thermal energy input to the stream of fluidic medium propagating through the apparatus can be regulated. Additionally, by making the space 5 variable it is possible to control a mechanism of pressure distribution along the fluid flow path and mixing levels.

The terms "variable" and "adjustable" are used interchangeably in the present context and indicate susceptibility of an area or a subject to modifications (adjustment).

Variable space 5 between the stationary blades 2, 4 can be realized in a single stage apparatus implementation or in the implementation comprising multiple- (or at least more than one) stage.

In embodiments, the apparatus 100 comprises a number of stages 10, wherein each stage is formed with three successive blade rows: the stationary nozzle guide vanes, the rotor blades and the stationary diffuser vanes. In embodiments, the apparatus is configured with at least two stages. Multistage configurations, including 2-10 rows of rotor blades mounted on the same shaft can be conceived. In such multistage configurations, the stages can be driven by the same or different (e.g. jointed) rotor shafts.

In a single stage or multiple stages, the stationary vanes 2, 4, as well as the rotor blades 3, can form a fixed or variable blade (inter)channel geometry by varying the blade angle (a blade setting angle).

The required duty of energy conversion could be achieved in a single stage or in a number of stages (multistage configuration). Connecting a number of stages together is beneficial when more specific energy input is required.

In the apparatus 100, the stages 10 can be arranged in parallel and/or in series.

Figure 2A:
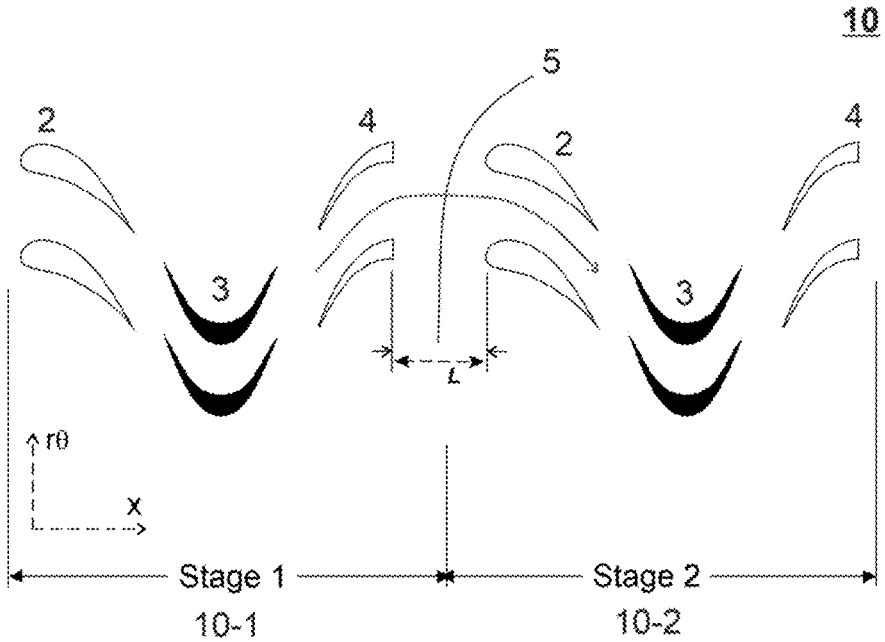
FIGS. 2A and 2B schematically illustrate the arrangements of stationary- and rotating blade rows in multistage configurations of the apparatus 100, according to the embodiments (three- and two-blade rows).
Figure 2B:
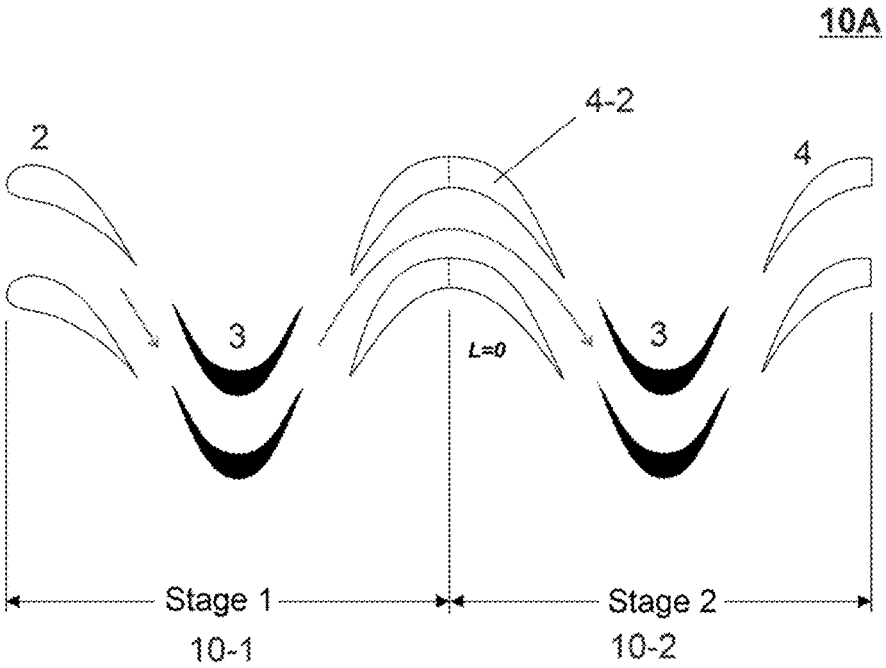

Reference is made to FIGS. 2A and 2B. FIG. 2A shows an exemplary multistage configuration comprising two stages 10 (10-1 and 10-2), each stage comprises the stator-rotor-stator/diffuser blade rows (2-3-4). The space 5 between the stages 10-1 and 10-2 can be defined, inter alia, as a distance L between a stationary diffuser vane or a row of stationary diffuser vanes of the upstream stage 10-1 and a stationary guide vane or a row of stationary guide vanes of the downstream stage 10-2.

Alike the space 5, also the distance L can be made variable (adjustable). The distance L between the adjacent stages 10-1, 10-2 is a span between trailing edge(s) of the stationary diffuser vane or the row of stationary diffuser vanes of the upstream stage 10-1 and the leading edge(s) of the stationary guide vane or the row of stationary guide vanes of the downstream stage 10-2 along a path formed with a sequence of stages plotted onto a common plane in successive order. In embodiments, the distance L is defined along a horizontal (longitudinal) axis of the apparatus 100, optionally in a direction of fluid flow.

In some configurations, the variable space 5 (and the distance L) is arranged between the at least one row of diffuser vanes and the at least one row of nozzle guide vanes.

The space 5 and/or the distance L between the diffuser vanes and the guide vanes, optionally, between the diffuser vanes of the upstream stage and the guide vanes of the downstream stator is/are made variable (adjustable) based on required flow conditions, such as a level of mixing and/or a pressure level. Along a distance between an upstream diffuser row and a downstream stationary guide row, the speed of fluidic stream is the lowest.

The distance L can be made variable in terms of modifying the span between the stationary blade rows, optionally between the adjacent stationary blade rows, optionally between the adjacent stages. On the other hand, adjusting/making variable the space 5 includes re-sizing and/or reshaping the interior of the apparatus 100 in a three-dimensional coordinate system. By modifying the space 5, also the distance L can be optionally modified and vice versa. A variety of implementations of the apparatus 100 can thus be conceived within the concept of variable space 5 and/or distance L between the adjacent stationary blade rows (see FIGS. 1A, 4 and 5, for example).

In embodiment, the at least one row of stationary diffuser vanes of the upstream stage 10-1 and at least one the row of stationary guide vanes of the downstream stage 10-2 are joined to form a single combined blade row 4-2 (FIG. 2B). The combined row 4-2 performs the duty of both the diffuser vanes and the guide vanes. In blade configuration shown on FIG. 2B, the distance L between the adjacent stages 10-1 and 10-2 is set to zero (L=0).

If needed, the space between the upstream diffuser vanes and the downstream guide vanes could also be increased to allow the greater space and time for mixing within the fluidic medium. In such an event, also the distance L can optionally be increased (L>0).

Overall, the size/volume of the space 5 (and the distance L) depends on at least the speed of fluidic flow through the apparatus 100. Thus, propagation of the fluidic medium, exiting the rotor at supersonic speed, through the stationary diffuser blades is accompanied with generation of a system of multiple shocks, therefore, increasing the space gap 5 may be beneficial in order to minimize shock wave interactions.

Figure 3A:
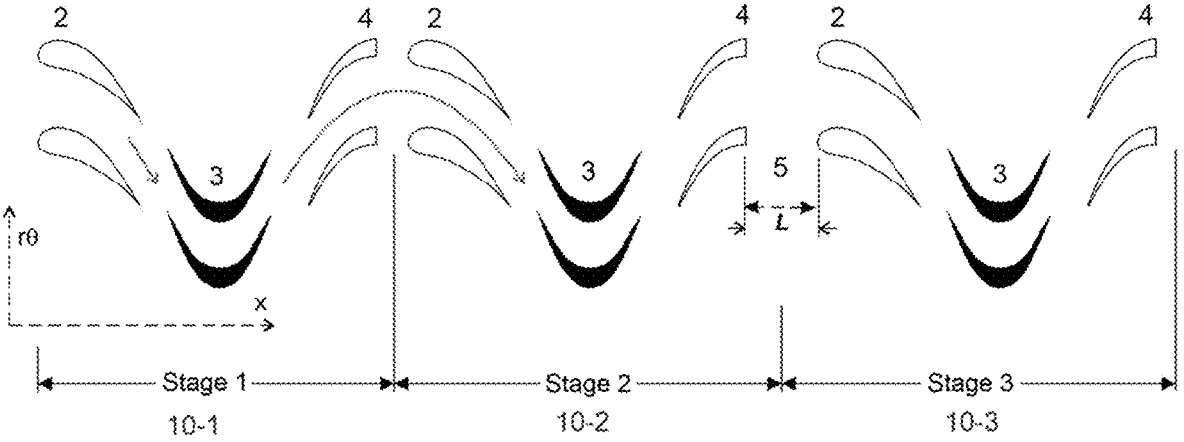
FIGS. 3A and 3B provide more detailed view of configurations presented on FIGS. 2A and 2B, respectively.
Figure 3A:
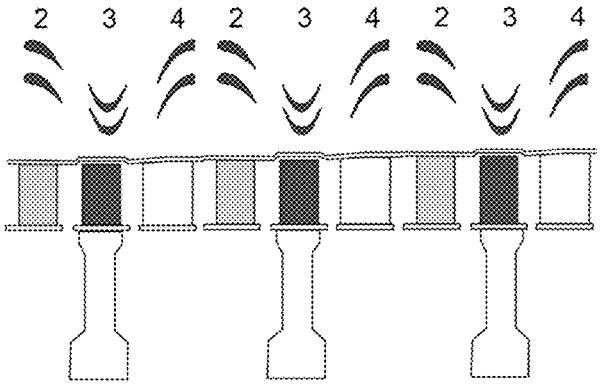
Figure 3B:
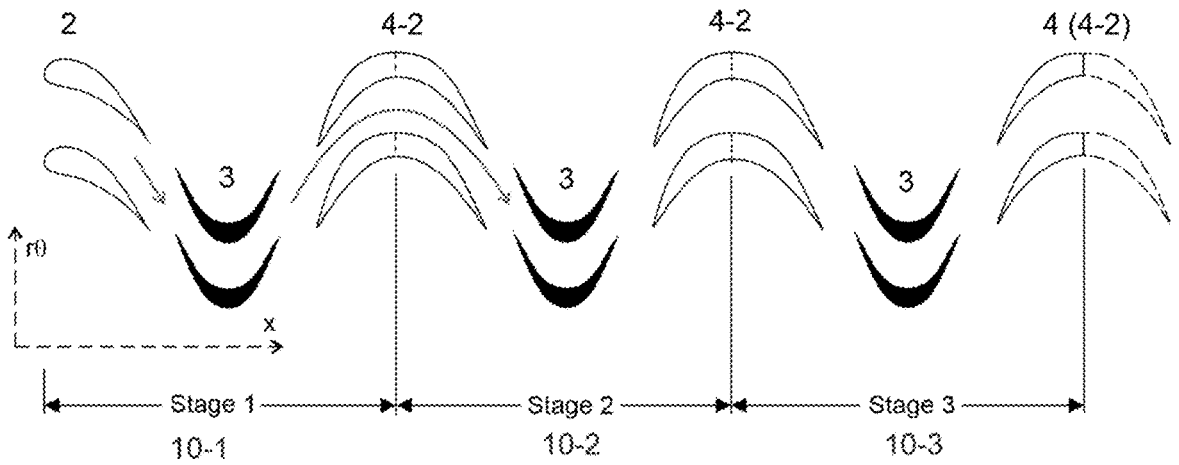
Figure 3B:
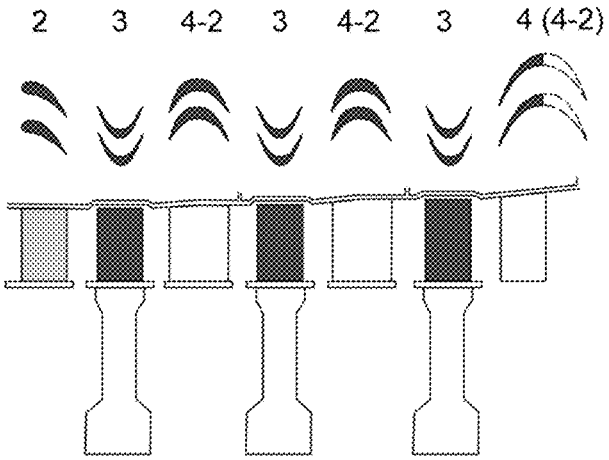
Figure 3C:
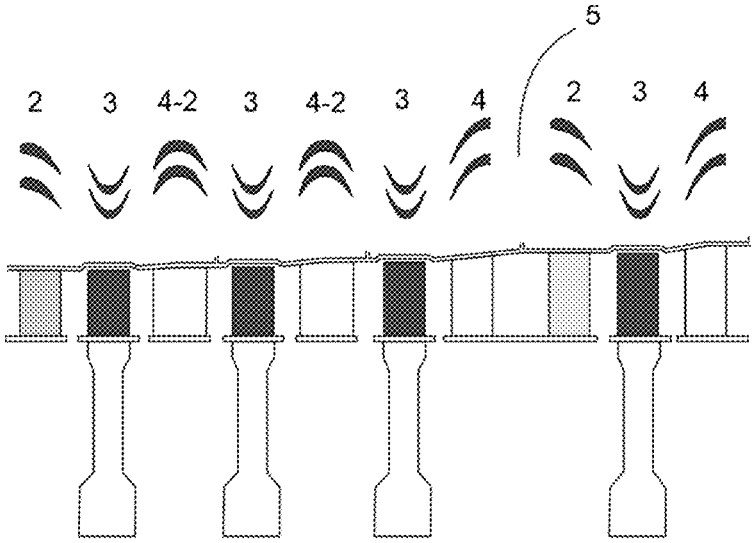
FIG. 3C shows an energy transfer stage solution, in which the embodiments shown on FIGS. 3A and 3B are combined.

FIGS. 3A and 3B illustrate in more detail the embodiments shown on FIGS. 2A and 2B, respectively. FIG. 3C shows a "mixed" stage solution, in which the embodiments shown on FIGS. 3A and 3B (three- and two-blade stages) are combined. FIG. 3C shows an exemplary embodiment of the apparatus 100 implemented with three (3) two-blade row stages and one (1) three-blade row stage, with the space 5 in between.

In embodiments, a terminating blade row within the apparatus 100 can be configured as a diffuser 4, an integrated diffuser-stator 4-2, or a turboexpander (not shown). The turboexpander is a turbomachine where the fluid propagating through the apparatus expands to reduce the static pressure and temperature, and outputs some shaft work to assist driving the apparatus 100. The turboexpander device can be used particularly when rapid temperature change is required. In embodiments, the apparatus 100 thus comprises, downstream of a last working (energy transfer/conversion) stage 10, a turboexpander device with a single- or multiple blade rows.

The dimensions, alignment and spatial disposition of the stationary vanes 2 (upstream of the rotor), the rotor blades 3 and/or the stationary vanes 4 (downstream of the rotor) are preferably individually adjustable within each stage by design (by manufacturing) or by operation. Thus, the stationary vanes and/or the rotor blades can vary within each stage in terms of at least dimensions, alignment and spatial disposition thereof, as preset (set up prior to and/or during operation) or as manufactured. In addition to being variable from stage to stage, said stationary vanes and/or rotor blades can be configured fixed (non-adjustable) and individually adjustable during the operation of the device.

In embodiments, the rotor blades are configured identical in all stages. In alternative embodiments, the rotor blades are made variable stagewise. In exemplary embodiments, the apparatus comprises a number of stages having rotor blade radius changing from stage to stage in a direction from inlet (11) to outlet (12) to meet the requirements of energy input and flow capacity. In embodiments, rotor blade height arbitrarily varies throughout the apparatus 100 in a longitudinal, optionally axial, direction.

Accordingly, the casing 20 can be modified to meet the requirements imposed by variable rotor blade height. In some configurations, the casing is thus configured to essentially follow the shape of the elements constituting individual stages. In some configurations, the casing has an essentially constant cross-section along its entire length. In some other configurations, the apparatus 100 has a casing the form of a (truncated) cone (rf. FIG. 1A, for example).

In some configurations, implementation of the rotary apparatus 100, embodied as 100B, generally follows a disclosure according to the U.S. Pat. No. 10,744,480 (Xu & Rosic), the entire contents of which are incorporated by reference herewith (rf. FIG. 4). In configuration 100B shown on FIG. 4 the casing 20 is provided as a confined space that encompasses (closely adjoins) the stationary guide vanes, the rotor blades and the diffuser forming at least one the energy transfer stage 10. The interior and optionally the external shape of the casing is configured to essentially follow the shape of the elements constituting said stage. Hence, in some instances, the casing 20 has a variable cross-sectional area across its interior (FIG. 4). In configuration 100B, the diffuser 4 is arranged in the space 5 (referred to as a mixing space and being established by a conduit comprising a bend section followed by a return channel). The mixing space can be configured variable in terms of its geometry and/or dimensional parameters.

The apparatus 100B can be configured as a modular structure, in which the casing 20 is established by number of modules 20A, 20B, 20C, 20D disposed one after another. Modular return channels and bend sections can be configured adjustable in terms of at least shape, length, cross-section and their spatial disposition within the apparatus 100, 100B.

In addition to multistage configurations 100A, 100B comprising a number of stages successively arranged along the rotor shaft, the three-blade row elemental stage can also be arranged in a regenerative multistage configuration, as illustrated in FIG. 5. Configuration 100C shown on FIG. 5 generally follows a disclosure according to the U.S. Pat. No. 7,232,937 (Bushuev), U.S. Pat. No. 9,494,038 (Bushuev) and U.S. Pat. No. 9,234,140 (Seppälä et al).

FIG. 5, shows, at illustration A, a configuration with two inlets 11-1, 11-2 and two outlets (12-1, the second outlet is not shown); other configurations may be conceived where appropriate.

The apparatus 100 embodied as 100C, comprises a rotor unit mounted onto the rotor shaft 1 positioned along a horizontal (longitudinal) axis X-X'. The rotor unit comprises a plurality of rotor blades 3 arranged over the circumference of a rotor disk. Stationary component is represented by a plurality of stationary guide vanes 2 and stationary diffuser vanes 4 arranged into essentially annular assemblies or cascades at both sides of the bladed rotor disk. A row of stationary guide vanes 2 is disposed upstream the rotor blade cascade 3 and the row of stationary diffuser vanes 4 is disposed downstream the rotor blade cascade in a direction of fluid flow through the apparatus between the at least one inlet and the at least one outlet.

In implementation 20, the casing 20 is configured to substantially fully enclose the periphery of the rotor disk with rotor blades assembled thereon and the rows of stationary vanes 2, 4 that adjoin the rotor blades and together form the stator-rotor-stator arrangement 2, 3, 4. The casing 20 has an essentially toroid shape (a "doughnut" shape) in three-dimensional configuration, whereby the rotor unit with related bearing assemblies may be viewed as filling up an aperture defining an opening in the central part of the toroid shape. At its meridional cross-section, the casing 20 is essentially ring-shaped.

In the casing 20, the blade rows 2, 3, 4 adjoin each other in such a way that the space 5 is created between the exit from the stator-rotor-stator arrangement (viz. the exit from the stationary diffuser blade row 4) and the entrance into said arrangement (viz. the entrance to the stationary guide vane row 2), in a manner explained herein above. In embodiments, the space 5 is formed between an inner surface of the casing 20 and the outer surface of the flow-shaping device 8. In embodiments, the space 5 is configured vaneless. In additional or alternative embodiments, the space 5 can comprise a number of guidewalls 7 (rf. FIG. 5, D).

The energy transfer/energy conversion stage is established with the three rows of blades (2, 3, 4), as described herein above. Stages are indicated, in FIG. 5, in roman numerals i-x. In configuration 100C, the flow exiting from the exit of the diffuser blade row 4 of one stage (stage i, for example) passes the (vaneless) space 5 and enters the row of stationary guide vanes 2 of the subsequent stage (stage ii) following a helical (helico-toroidal) path. The flow passes through the successive blade rows 2, 3, 4 (stage ii), exits the diffuser 4 (stage ii), and continues towards next stage(s) iii-x until the flow reaches the outlet 12-1 (rf. illustrations B and C, where illustration C shows the stages i-x plotted on the same plane). Direction of the flow is indicated with an arrow. The number of stages is determined by the process duty, required temperature and/or pressure level.

In configuration 100C, the space 5 can be varied in terms of at least size in shape. Hence, at least size and shape of the toroidal flow path created between the stages by virtue of the space 5 can vary based on required length (see illustration C) and the level of mixing. In some embodiments, the space 5 contains a number of flow guide appliances, such as guidewalls 7 (rf. FIG. 5, D). The guidewalls 7 partition the flow path and create additional individual passes.

Figure 6:
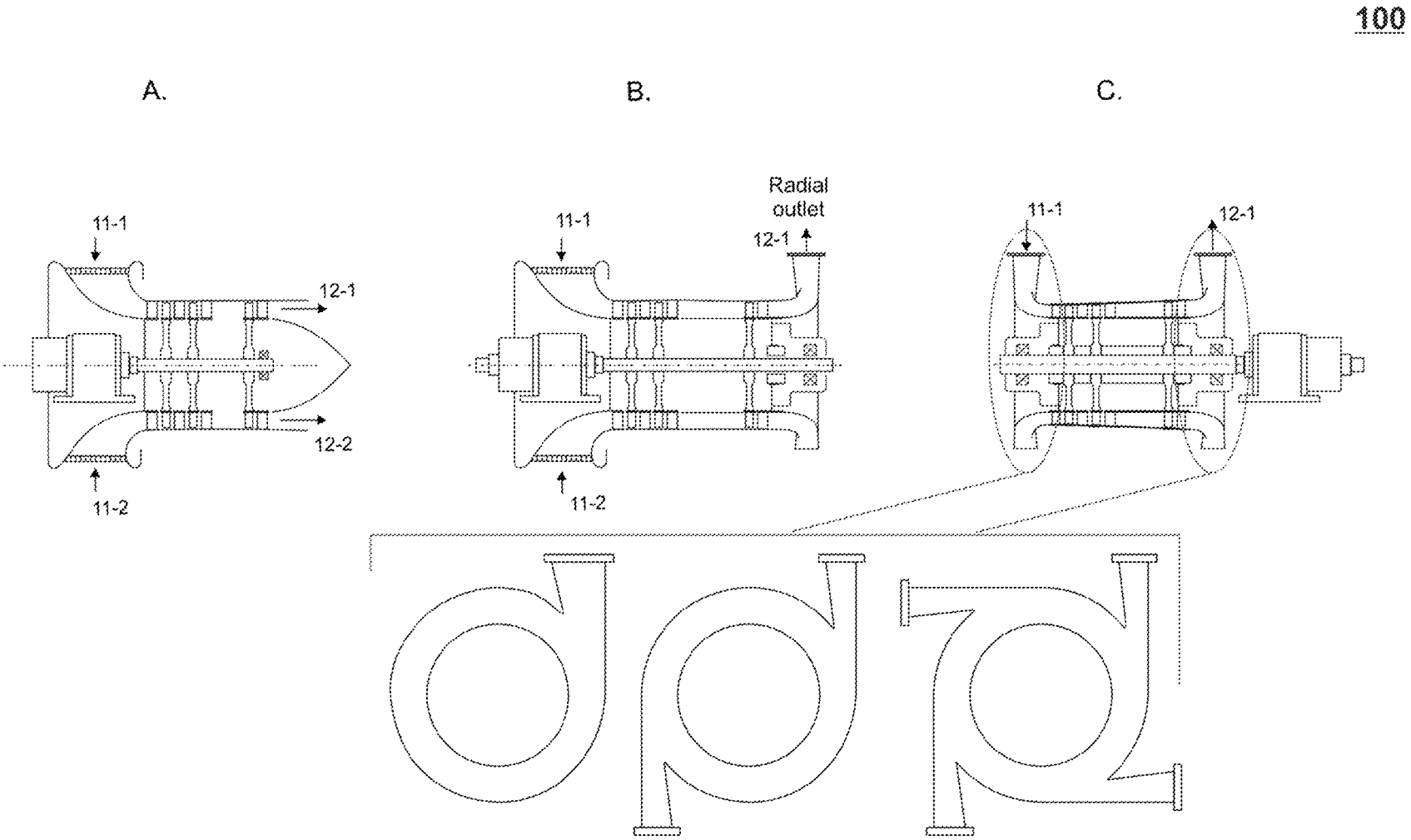
FIG. 6 illustrates exemplary configurations for inlet- and outlet arrangements for the apparatus 100.

Reference is made to FIG. 6 illustrating exemplary configurations for inlet- and outlet arrangements for the apparatus 100. In embodiments, the apparatus may comprise a stage or stages comprising the inlet and outlet arrangements. In some configurations, such stages may not be configured as working stages (i.e. adapted for energy transfer into the fluid), but merely for receiving- and discharging the fluid, respectively. In some other configurations, the inlet- and outlet stages may be configured as fully working stages.

The inlet(s) and outlet(s) comprise a related opening/port in the casing, as well as pipes, sleeves and/or manifolds associate with each said port. In exemplary configurations, fluid can be delivered at the at least one inlet 11 (11-1, 11-2) through a radial-to-axial transition duct (rf. FIG. 6, A) or a number of circumferential sectors or pipes with different axial, radial or circumferential inlet velocity components (rf. FIG. 6, B, C). The at least one outlet 12 (12-1, 12-2) or a stage comprising the outlet can be in turn configured as a circumferential volute with a single pipe or multiple pipes and/or with an axial, radial or circumferential duct.

FIG. 6 illustrates, at A the apparatus 100 comprising at least one axial-radial inlet 11 (11-1, 11-2) and at least one axial outlet 12 (12-1, 12-2). Illustration B shows the apparatus 100 with at least one axial-radial inlet 11 (11-1, 11-2) and at least on radial outlet 12 (12-1). Illustration C show the apparatus 100 with at least one radial inlet 11 (11-1) and at least one radial outlet 12 (12-1). Exemplary volute configurations with a single- or multiple inlet and outlet ducts are shown at FIG. 6, C.

In some configurations, the apparatus 100 can further comprise an additional inlet port 13 within the inlet stage (rf. FIG. 4). Applicable to configuration 100B shown on FIG. 4, the additional inlet port 13 is configured as a scroll inlet to produce highly swirled flow to the rotor.

In embodiments, the apparatus 100 (embodied hereby as any one of 100A, 100B, 100C) further comprises at least one stage 14 configured to adjust a (static) pressure change across a corresponding row of the rotor blades, and/or to control the pressure level through the apparatus 100. In particular, such pressure-adjusting (or pressure-changing) stage 14 is configured to raise the pressure in the apparatus 100. Additionally, the stage 14 allows for rapidly adding more thermal energy (heat) to the fluid. Such stage(s) 14 is/are required when the feedstock flow properties (pressure, temperature, mass flow rate etc.) do not match conditions required for the apparatus 100.

Figure 7:
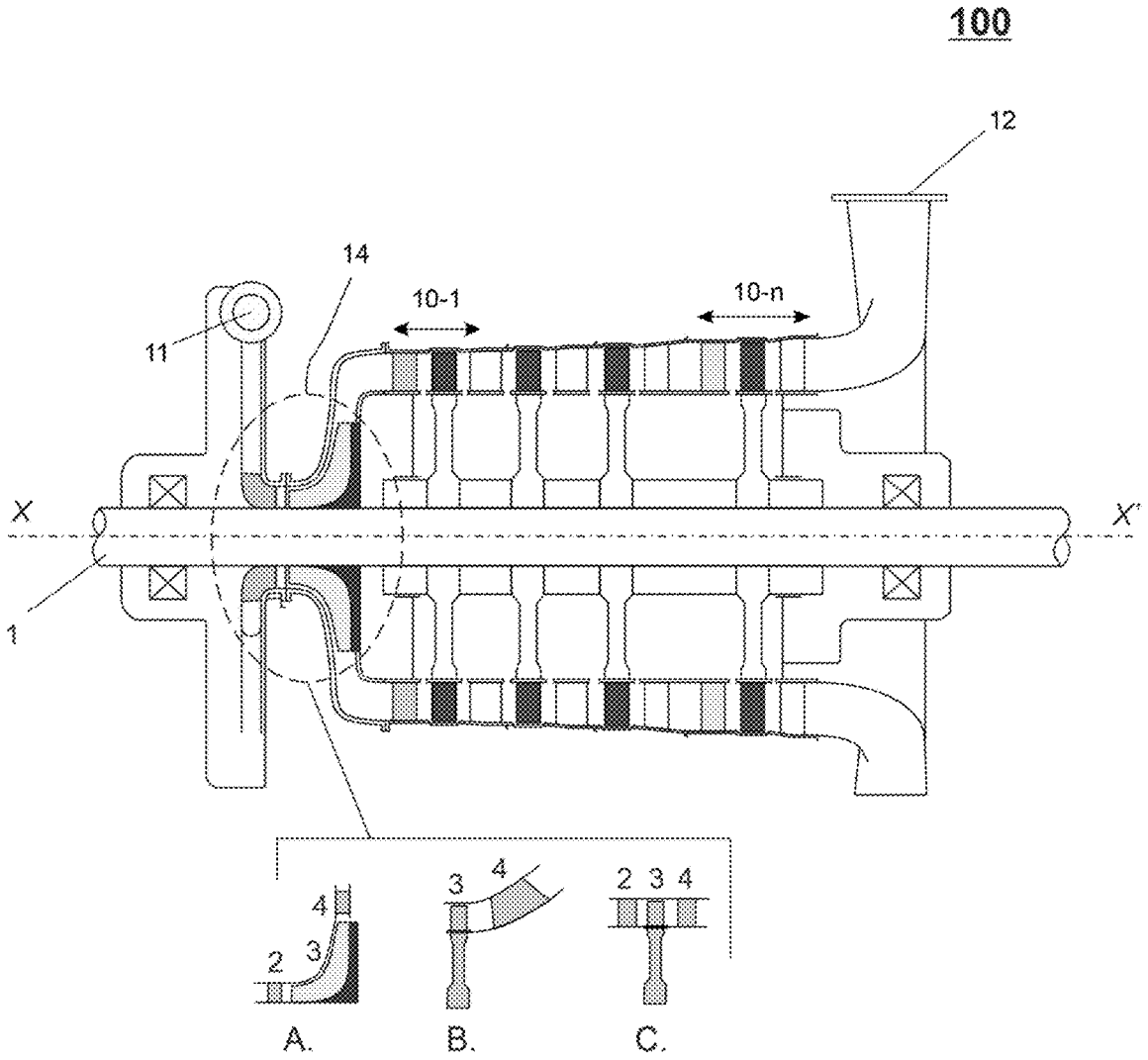
FIG. 7 shows a pressure-adjusting stage within the apparatus.

FIG. 7 shows the apparatus 100 comprising the pressure adjusting stage 14 arranged at the inlet 11. In additional or alternative configurations, the stage(s) 14 can be arranged at the outlet 12 of the apparatus and/or between the working (energy transfer/conversion) stages 10-1, **10-*n* (not shown). Working stages 10-1-10-*n*** can be configured with three-, two- or mixed blade rows, as describe herein above.

Stage 14 typically has different (enhanced) loading to provide higher loading input, when compared to the working stages **10-1-10-*n*. The stage(s) 14** can be viewed as altering the pattern of thermal energy input in comparison to the working stages.

The pressure adjusting stage 14 can adopt various configurations, depending on the apparatus design. By way of example, FIG. 7 shows the stage 14 configurations for radial flow (A), mixed flow (B) and axial flow (C). Other appropriate configurations can be adapted. Stage(s) 14 can be configured as single- or multistage; and its configuration can further vary depending on its placement within the apparatus 100.

In embodiments, the pressure changing stage(s) 14 can be configured to differ from the working stages **10-1-10-*n* in terms of structure and arrangement of the stationary and/or rotating components. Thus, stage(s) 14** may comprise a rotor with adjustable blade angle; optionally, also a stator with adjustable blade angles. Blade angle can be adjusted to meet process conditions (type of feedstock and its pressure, temperature, mass flow rate, etc.).

Additionally or alternatively, the stage(s) 14 may be implemented structurally essentially identical to the working stages 10. In such an event, the pressure changing/pressure raising property can be achieved through installing the stage(s) 14 at a separate rotor shaft capable of providing a higher rotor speed. A two-spool engine configuration for example can thus be adapted for the apparatus 100, connecting the working stages 10 and the pressure adjusting stages 14 to separate shafts rotating at different speeds.

The apparatus 100 implemented with a single- and multiple shaft configurations is illustrated on FIG. 8. The apparatus units (100-1, 100-2, 100-3) implemented as single- or multistage units, can be arranged on multi-spools in parallel (FIG. 8, B, multi-spool arrangement in parallel) or in series (FIG. 8, A, multi-spool arrangement in series). Assemblies **100*n* comprising apparatus units 100-1, 100-2** connected in series and in parallel are shown in corresponding dashed boxes.

Each spool can be driven by a separate prime mover 15 (15-1, 15-2, 15-3), configured as a drive unit selected of any one of: an electric motor, a gas turbine, a steam turbine or a combination thereof. Each spool could have same or different rotational speed according to the specific duty required. In some embodiments, the drive unit is preferably an electric motor.

On the whole, each stage (the working stages 10 and the pressure adjusting stages 14) can be configured with different workload and/or capacity.

The apparatus 100 advantageously comprises a rotor shaft sealing system (not shown). A system of seals, including, but limited to labyrinth seals, brush seals and/or leaf seals is applied around the rotor shaft in order to prevent leakage of the fluid outside of the apparatus 100. A coolant flow at specified pressure and temperature is used to pressurize the rotor cavity and prevent the leakage of the working fluid.

The apparatus 100 configured in accordance with the embodiments described hereinabove has tolerance for relatively wide variations of design parameters. In particular, a multistage solution can be configured with a number of stages each having different volume flow rate/volume flow capacity. Thus, the work input requirements and/or mixing levels can be adjusted/regulated separately within each stage.

In all configurations 100, the flow rate can be adjustable, optionally stage-wise, by changing the rotor size (diameter, quadruple increase) and/or the blade height (linear increase). Variable height for the rotor blades may be achieved by adjusting the axial location of the rotor blade rows on the rotor shaft, which allows for changing volume flow rates through the different stages having similar design. Blade root-to-tip radius ratio can be adjusted accordingly dependent on the apparatus configuration. Stationary blades (2, 4) can be adjusted accordingly. Modifying blade parameters in a manner indicated above allows for increasing volume flow capacity through the apparatus (considering for example that at the end/outlet of the apparatus both temperature and work input requirement are the highest).

In embodiments, the apparatus 100 further comprises a number of catalytic surface(s) or other catalytic element(s) (not shown). Catalytic surfaces can be formed by catalytic coatings of at least some of the individual blades or vanes of the at least one blade/vane row (2, 3, 4), the rotor hub/disc, and/or the casing surfaces at the predefined locations within the interior of the apparatus. Catalytic elements may be configured as (porous) ceramic or metallic substrate(s) or support carrier(s) with an active coating. Alternatively, monolithic honeycomb catalysts may be utilized.

In embodiments, the apparatus 100 (100A, 100B, 100C) further comprises appliances for intermediate injection- and/or extraction. Said appliances (not shown) comprise a number of ports and conduits optionally arranged into manifolds configured to connect the apparatus 100 with an intermediate facility, such as a heat exchanger, a heater, a source chemical, and the like. By way of example, the apparatus 100 can be connected to at least one heat exchanger through a system of injection/extraction conduits. In such an arrangement, a part of heated fluid is withdrawn from the apparatus 100 through extraction conduit(s) and directed into the heat exchanger(s), where thermal energy is extracted from the fluid. The heat exchanger(s) may be configured to cool the extracted fluid from 1000-1500 degree Celsius to about less than 1000 degree Celsius, for example. Cooled fluid is either injected (through the injection conduit(s)/port(s)) back to the process flow propagating through the apparatus 100 (viz. for internal heating) or used in the cooling arrangement described herein above.

In additional or alternative configurations, similar arrangement can be adopted for feeding, into the apparatus 100, of fluid(s) cooled or heated elsewhere (e.g. steam) and/or for injecting chemicals (catalysts, additives, dopants, etc.). In such configuration(s), the intermediate facility is formed with a number of additional heat exchangers, heaters and/or relative chemical sources. To regulate an amount of extracted/injected fluid, the extraction/injection ports and associated manifolds are supplied with valves, e.g. three-way valves, and related detectors.

Extraction and/or injection ports can be arranged at any location, along the casing 20, between the inlet 11 and the outlet 12. In some instances, it is preferred that fluidic medium is withdrawn from the apparatus for heat extraction essentially at a midpoint of a heating process.

Upon connecting at least two apparatuses 100 in parallel or in series, an assembly 100*n* can be established (rf. FIG. 8). Connection between said apparatuses can be mechanical and/or functional. Functional (in terms of processing similar feedstocks, for example) connection can be established upon association between at least two physically integrated- or non-integrated individual apparatus units 100 (100-1, 100-2, 100-3). In a latter case, association between the at least two apparatuses 100 can be established via a number of auxiliary installations (not shown). In some configurations, the assembly comprises the at least two apparatuses at least functionally connected via their central shafts such, as to mirror each other. Such mirrored configuration can be further defined as having at least two apparatuses 100 mechanically connected in series (in a sequence), whereas functional (e.g. in terms of inputting heat into fluids) connection can be viewed as connection in parallel (in arrays). In some instances, the aforesaid "mirrored" assembly can be further modified to comprise at least two inlets and a common exhaust (discharge) stage placed essentially in the center of the assembly (not shown).

Figure 11:
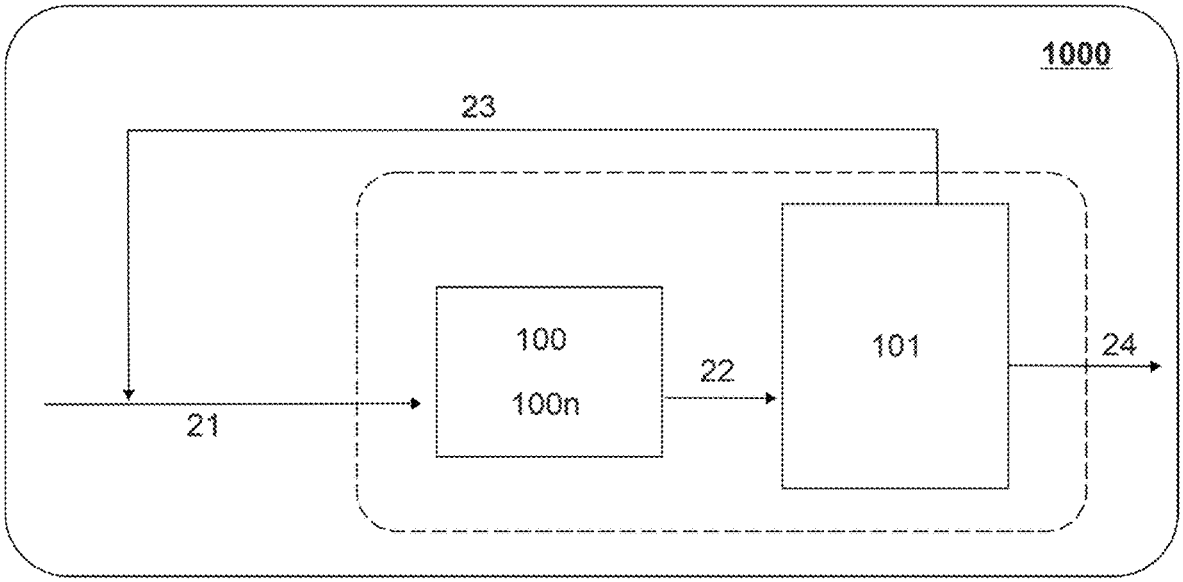
FIG. 11 schematically shows an arrangement comprising at least one apparatus 100 or the assembly 100*n* and at least one heat-consuming unit/utility 101, and a heat-consuming system 1000.

Upon connecting the at least one rotary apparatus 100 or the assembly 100*n* to at least one heat-consuming unit/utility 101, an arrangement may be established (see dashed box, FIG. 11), which arrangement may further be a part of a heat-consuming system 1000.

The apparatus(es) 100, 100*n* may be connected to a common heat-consuming unit/utility 101 directly or indirectly, e.g. through a number of heat exchangers. The heat-consuming unit/utility 101 include, but are not limited to: a furnace, an oven, a kiln, a heater, a burner, an incinerator, a boiler, a dryer, a conveyor device, a reactor device, or a combination thereof.

The heat-consuming process system 1000 is a facility configured to carry out a heat-consuming industrial process or processes implemented through the number of units/utilities 101 at temperatures essentially equal to- or exceeding about 500 degrees Celsius (° C.). In embodiments, the facility is configured to carry out the heat-consuming industrial process(es) at temperatures essentially equal to- or exceeding about 1200° C., preferably, at temperatures essentially equal to or exceeding about 1400° C., still preferably, at temperatures essentially equal to or exceeding about 1700° C. Temperatures up to 2000-2500° C. can be achieved upon application of cooling technologies described herein above. The system 1000 is not excluded from carrying out of at least a part of industrial processes at temperatures below 500° C.

The heat-consuming unit(s)/utilities and the heat-consuming process(es) is/are designated by the same reference numeral 101. This is to emphasize that the section 101 designates a process unit configured as an industrial plant, a factory, or any industrial system comprising equipment designed to perform an industrial process or a series of industrial processes aiming at producing goods from essentially raw materials or raw energy sources. In the present disclosure, the expression "producing goods" includes, but is not limited to manufacture, extraction and/or refinement with regard to a material (such as steel or chemical compounds, in the present context) and/or power. In some embodiments, the section 101 represents a heat-consuming utility, such as a furnace or a reactor device, for example, configured to carry out the heat-consuming process.

Mentioned processes typically have high thermal (heat) energy demand and consumption and, in conventional solutions (viz. outside the heat integration scheme 1000 presented herewith), constitute most of industrial emissions (gases and aerosols) into the atmosphere. Present disclosure offers apparatuses and methods for inputting thermal energy into fluids, which can be further used in a variety of conventional industrial processes (101) with high heat energy demand, whereby energy efficiency in said processes can be markedly improved and the amount of air pollutants released into the atmosphere is reduced. The apparatus 100 can thus be adopted for use as a heater.

An amount of input energy is conducted into the at least one rotary apparatus 100/assembly 100*n* connected to the heat-consuming unit(s) and/or integrated into the system 1000. In embodiments, the input energy comprises electrical energy. In embodiments, the amount of electrical energy conducted as the input energy into the at least one apparatus 100 integrated in the heat-consuming system/process facility 1000 is provided within a range of about 5 to about 100 percent, preferably, within a range of about 50 to about 100 percent. Thus, the amount of electrical energy conducted as the input energy into the at least one apparatus 100 integrated in the system 1000 can constitute any one of: 5, 10, 15, 20, 25, 30, 35, 40, 45, 50, 55, 60, 65, 70, 75, 80, 85, 90, 95, and 100 percent (from the total energy input), or any intermediate value falling in between the above indicated points.

The apparatus 100 acts at least as a heater on the fluidic medium (feed 21). The heated fluid enters the heat-consuming process 101 as the stream 22 and exits the process 101/the system 1000, as an exhaust stream 24. At least a part of the fluid can be recycled in the system and returned back to a feed pretreatment (arrow 23; pretreatment unit is not shown).

The high temperature heat—heat-consuming system 1000 is thus configured to carry out at least one heat-consuming process including, but not limited to the: steel manufacturing; cement manufacturing; production of hydrogen and/or synthetic gas, such as steam-methane reforming; conversion of methane to hydrogen, fuels and/or chemicals; thermal energy storage, such as high temperature heat storage; processes related to oil- and/or petrochemical industries; catalytic processes for endothermic reactions; processes for disposal of harmful and/or toxic substances by incineration, and processes for manufacturing high-temperature materials, such as glass wool, carbon fiber and carbon nanotubes, brick, ceramic materials, porcelain and tile.

In an aspect, a method for inputting thermal energy into a fluidic medium is provided, said method comprises at least the following steps:

(a) obtaining a rotary apparatus 100 (100A, 100B, 100C) implemented in accordance with the embodiments described herein above, and comprising:
  a casing with at least one inlet and at least one outlet,
  a rotor comprising at least one row of rotor blades configured as impulse impeller blades arranged over a circumference of a rotor hub mounted onto a rotor shaft,
  at least one row of stationary nozzle guide vanes arranged upstream of the at least one row of the rotor blades, respectively, and
  at least one row of stationary diffuser vanes arranged downstream of the at least one row of the rotor blades, respectively, (b) adjusting rotation speed of the rotor to a predetermined speed or a speed range to reach the fluidic medium flow rate that satisfies the requirements imposed by the process;

(c) adjusting a preheating level of the fluidic medium;

(d) directing a stream of fluidic medium along a flow path formed inside the casing between the inlet and the outlet such, that an amount of thermal energy is imparted to a stream of fluidic medium by virtue of series of energy transformations occurring when said stream of fluidic medium successively passes through the blade/vane rows formed by the nozzle guide vanes, the rotor blades and the diffuser vanes, respectively.

In the method, the amount of thermal energy input to the stream of fluidic medium propagating through the apparatus is regulated by varying a space formed between an exit from the at least one row of diffuser vanes and an entrance to the at least one row of nozzle guide vanes in a direction of the flow path formed inside the casing between the inlet and the outlet.

In embodiments, the fluidic medium comprises any one of: a feed gas, a recycle gas, a make-up gas, and a process fluid. In embodiments, the fluidic medium stream enters the rotary apparatus in an essentially gaseous form. In embodiments, the flow rate of the stream of fluidic medium is adjustable during operation of the rotary apparatus. Adjusting the flow rate can be implemented through adjusting the speed of rotation of rotor shaft, optionally stagewise.

It is clear to a person skilled in the art that with the advancement of technology the basic ideas of the present invention may be implemented in various ways. The invention and its embodiments may generally vary within the scope of the appended claims.

The invention claimed is:

1. A rotary apparatus for inputting thermal energy into fluidic medium, comprising:
  a casing with at least one inlet and at least one outlet,
  a rotor comprising a plurality of rows of rotor blades configured as impulse impeller blades arranged over a circumference of a rotor hub mounted onto a rotor shaft,
  a plurality of rows of stationary nozzle guide vanes, each row of stationary nozzle guide vanes arranged upstream of one of the rows of rotor blades, wherein the plurality of rows of stationary nozzle guide vanes comprises at least a first row, a second row, and a third row of stationary nozzle guide vanes, respectively, and
  a plurality of rows of stationary diffuser vanes, each row of stationary diffuser vanes arranged downstream of one of the rows of rotor blades, wherein the plurality of rows of stationary diffuser vanes comprises at least a first row, a second row, and a third row of diffuser vanes, respectively,
  wherein the apparatus is configured to impart an amount of thermal energy to a stream of fluidic medium directed along a flow path formed inside the casing between the inlet and the outlet by virtue of a series of energy transformations occurring when said stream of fluidic medium successively passes through the blade/vane rows formed by the nozzle guide vanes, the rotor blades and the diffuser vanes, respectively, and
  wherein, in said apparatus, a first space formed between an exit from the first row of stationary diffuser vanes and an entrance to the second row of nozzle guide vanes in a direction of the flow path formed inside the casing between the inlet and the outlet has a length, size, and/or shape that is varied from a length, size, and/or shape of a second space formed between an exit from the second row of diffuser vanes and an entrance to the third row of nozzle guide vanes to regulate the amount of thermal energy input to the stream of fluidic medium propagating through the apparatus.

2. The apparatus of claim 1, wherein said first space is vaneless.

3. The apparatus of claim 1, wherein said first space comprises flow shaping device(s) and/or flow guide appliance(s), such as guidewalls.

4. The apparatus of claim 1, wherein the plurality of rows of stationary nozzle guide vanes, the plurality of rows of rotor blades and the plurality of rows of stationary diffuser vanes are configured to produce conditions, at which an amount of kinetic energy added to the stream of fluidic medium by rotating blades of the rotor is sufficient to raise the temperature of the fluidic medium to a predetermined value when said stream of fluidic medium exits one row of the plurality of rows of rotor blades at a supersonic speed and passes through an adjacent row of diffuser vanes, where the stream decelerates and dissipates kinetic energy into an internal energy of the fluidic medium, and an amount of thermal energy is added to the stream of fluidic medium.

5. The apparatus of claim 1, in which the amount of thermal energy added to the stream of fluidic medium propagating through the apparatus is produced by virtue of generation of a system of shock waves during successive propagation of said stream of fluidic medium through one row of the plurality of rows of stationary nozzle guide vanes, one row of the plurality of rows of rotor blades and one row of the plurality of rows of stationary diffuser vanes, respectively, in a controlled manner.

6. The apparatus of claim 1, wherein each row of stationary nozzle guide vanes is configured as a flow conditioner device that directs the stream of fluidic medium towards an adjacent row of rotor blades in a circumferential direction opposite to rotor blade rotation such, as to control the level of energy input from the rotor and the speed of the fluid.

7. The apparatus of claim 1, wherein the stationary nozzle guide vanes are configured to direct the stream of fluidic medium to enter an adjacent row of rotor blades with a relative blade angle within a range of between about 45 degrees to about 75 degrees as viewed from the axial direction.

8. The apparatus of claim 1, wherein the rotor blades are configured, upon rotation of the rotor, to receive the stream of fluidic medium from an adjacent row of stationary nozzle guide vanes and to accelerate said stream to a supersonic speed thus imparting mechanical energy to the process fluid by increasing tangential velocity thereof.

9. The apparatus of claim 1, wherein the plurality of rows of rotor blades are configured to receive the stream of fluidic medium entering from any one of the axial-, diagonal- or radial directions and to cause changes in flow velocity such that the stream of fluidic medium is accelerated at least two-fold.

10. The apparatus of claim 1, wherein the rotor is configured, in terms of profiles and dimensions of the rotor blades and disposition thereof on the rotor hub, to control mechanical energy input to the stream of fluidic medium.

11. The apparatus of claim 1, wherein the plurality of rows of diffuser vanes is configured as an energy converter device, that converts mechanical energy of the fluidic medium into thermal energy of said fluidic medium.

12. The apparatus of claim 1, wherein the rotor comprises a shroud configured to cover the plurality of rows of rotor blades.

13. The apparatus of claim 1, wherein the first row of stationary nozzle guide vanes, the first row of rotor blades and the first row of stationary diffuser vanes establish an energy transfer stage, configured to mediate a complete energy conversion cycle.

14. The apparatus of claim 1, further comprising a number of energy transfer stages, wherein said number of energy transfer stages is at least three.

15. The apparatus of claim 14, further comprising a number of energy transfer stages arranged in parallel and/or in series.

16. The apparatus of claim 14, wherein the distance between the energy transfer stages defined as a distance between the row of stationary diffuser vanes of a first energy transfer stage and the row of stationary nozzle guide vanes of a second energy transfer stage successive to the first energy transfer stage is variable.

17. The apparatus of claim 14, wherein the distance between the energy transfer stages is determined based on required flow conditions, such as a level of mixing and/or a pressure level.

18. The apparatus of claim 14, wherein the first row of stationary diffuser vanes is associated with a first energy transfer stage and the second row of stationary nozzle guide vanes is associated with a second energy transfer stage successive to the first energy transfer stage, wherein the first row of stationary diffuser vanes and the second row of stationary nozzle guide vanes are joined to form a combined blade row, whereby the distance between the first stage and the successive second energy transfer energy transfer stage is set to zero.

19. The apparatus of claim 14, further comprising at least one stage configured to adjust pressure across a corresponding row of the rotor blades.

20. The apparatus of claim 19, in which each energy transfer stage and each pressure adjusting stage is established, in terms of its structure and/or controllability over the operation thereof, independently from the other stages.

21. The apparatus of claim 19, wherein the stationary vanes and/or the rotor blades are individually adjustable within each stage, in terms of at least dimensions, alignment and spatial disposition thereof, during the operation of the apparatus.

22. The apparatus of claim 19 further comprising rotor blade rows having blade radius configured variable stagewise, optionally in a direction from the inlet to outlet.

23. The apparatus of claim 1, wherein at least one inlet or a stage comprising the at least one inlet is configured to receive the stream of fluidic medium through a radial-to-axial transition duct or a number of circumferential sectors or pipes with different axial, radial or circumferential inlet velocity components.

24. The apparatus of claim 1, wherein at least one outlet or a stage comprising the at least one outlet is configured as a circumferential volute with at least one pipe and/or with an axial, radial or circumferential duct.

25. The apparatus of claim 1, further comprising a turboexpander device arranged downstream of a last energy transfer stage.

26. The apparatus of claim 1, wherein the rotary apparatus is configured to be electrically operated by virtue of being driven by at least one electric drive engine.

27. The apparatus of claim 1, further comprising a cooling arrangement optionally together with temperature resistant coatings and/or components made of temperature resistant materials.

28. The apparatus of claim 1, further provided with a number of catalytic surfaces and/or catalytic elements.

29. Use of the apparatus as defined in claim 1 in generation of the fluidic medium heated to the temperature essentially equal to or exceeding about 500 degrees Celsius (° C.), preferably, to the temperature essentially equal to or exceeding about 1000° C., still preferably, to the temperature essentially equal to or exceeding about 1400° C., and still preferably, to the temperature essentially equal to or exceeding about 1700° C.

30. Use according to claim 29, wherein the temperature rise achievable per an energy transfer stage is within a range of 10-1000° C.

31. An assembly comprising at least two rotary apparatuses according to claim 1 functionally connected in parallel or in series.

32. The assembly of claim 31, wherein the at least two apparatuses are connected such, as to mirror each other, whereby their shafts are at least functionally connected.

33. An arrangement comprising at least one rotary apparatus according to claim 1 connected to at least one heat-consuming unit.

34. The arrangement of claim 33, wherein the heat-consuming unit is any one of: a furnace, an oven, a kiln, a heater, a burner, an incinerator, a boiler, a dryer, a conveyor device, a reactor device, or a combination thereof.

35. A heat-consuming system configured to implement an industrial heat-consuming process and comprising at least one rotary apparatus according to claim 1.

36. The heat-consuming system of claim 35, wherein the industrial heat-consuming process is selected from the group consisting of: steel manufacturing; cement manufacturing; production of hydrogen and/or synthetic gas, such as steam-methane reforming; conversion of methane to hydrogen, fuels and/or chemicals; thermal energy storage, such as high temperature heat storage; processes related to oil- and/or petrochemical industries; catalytic processes for endothermic reactions; processes for disposal of harmful and/or toxic substances by incineration, and processes for manufacturing high-temperature materials, such as glass wool, carbon fiber and carbon nanotubes, brick, ceramic materials, porcelain and tile.

37. The apparatus of claim 1, wherein the casing comprises a number of modules disposed one after another, and wherein the space formed between the exit from the at least one row of diffuser vanes and the entrance to the at least one row of nozzle guide vanes in a direction of the flow path formed inside the casing between the inlet and the outlet is made variable by modular return channels and bend sections formed between the modules.

38. A method for inputting thermal energy into a fluidic medium, comprising:

(a) providing a rotary apparatus according to claim 1, (b) adjusting a rotation speed of the rotor to a predetermined speed or to a predetermined range of speeds so that the fluidic medium reaches a flow rate that satisfies predetermined process requirements;

(c) adjusting a preheating level of the fluidic medium; and (d) directing a stream of the fluidic medium along the flow path such that an amount of thermal energy is imparted to a stream of fluidic medium by virtue of series of energy transformations occurring when said stream of fluidic medium successively passes through the blade/vane rows formed by the nozzle guide vanes, the rotor blades and the diffuser vanes, respectively, wherein, in said method, the amount of thermal energy imparted to the stream of fluidic medium propagating through the apparatus is regulated by varying the first space.

39. The method of claim 38, wherein the fluidic medium comprises any one of a feed gas, a recycle gas, a make-up gas, and a process fluid.

40. The method of claim 38, wherein the fluidic medium enters the apparatus in a gaseous form.

41. The method of claim 38, wherein the fluidic medium flow rate is adjustable during operation of the apparatus.

* * * * *